US008272233B2

(12) United States Patent
Yoshimura et al.

(10) Patent No.: US 8,272,233 B2
(45) Date of Patent: Sep. 25, 2012

(54) HEAT EXCHANGER AND REFRIGERATING AIR CONDITIONER

(75) Inventors: Susumu Yoshimura, Tokyo (JP); Shinichi Wakamoto, Tokyo (JP); Hajimu Yoshiyasu, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 718 days.

(21) Appl. No.: 12/295,630

(22) PCT Filed: Apr. 14, 2006

(86) PCT No.: PCT/JP2006/307932

§ 371 (c)(1), (2), (4) Date: Oct. 1, 2008

(87) PCT Pub. No.: WO2007/122685

PCT Pub. Date: Nov. 1, 2007

(65) Prior Publication Data

US 2010/0162749 A1 Jul. 1, 2010

(51) Int. Cl.
*F25B 41/00* (2006.01)

(52) U.S. Cl. ..... 62/513; 62/515

(58) Field of Classification Search ..... 62/513, 62/515, 498; 165/173, 110
See application file for complete search history.

(56) References Cited

U.S. PATENT DOCUMENTS 3,616,022 A 10/1971 Withers
3,936,288 A 2/1976 Pei
4,208,198 A * 6/1980 Small ..... 62/657
4,880,055 A * 11/1989 Niggemann et al. ..... 165/167
5,095,712 A 3/1992 Narreau
5,242,015 A 9/1993 Saperstein et al.
5,816,322 A * 10/1998 Albano et al. ..... 165/173
5,875,837 A 3/1999 Hughes
5,996,364 A 12/1999 Lifson et al.
6,000,461 A * 12/1999 Ross et al. ..... 165/79
6,244,333 B1 * 6/2001 Bergh et al. ..... 165/165
6,386,277 B1 5/2002 Wattelet
6,959,758 B2 * 11/2005 Hughes et al. ..... 165/165
7,398,643 B2 * 7/2008 Cotton ..... 60/275
2002/0134097 A1 9/2002 Ichikawa et al.
2003/0178188 A1 9/2003 Coleman
2004/0069475 A1 * 4/2004 Brost et al. ..... 165/173

(Continued)

FOREIGN PATENT DOCUMENTS

CN 1246604 A 3/2000

(Continued)

OTHER PUBLICATIONS

Translation of JP 2002-098424 A to Tanaka et al.*

(Continued)

*Primary Examiner* — Mohammad Ali
(74) *Attorney, Agent, or Firm* — Leydig, Voit & Mayer, Ltd.

(57) ABSTRACT

A heat exchanger includes a first flat tube in which a low temperature fluid flows and a second flat tube in which a high temperature fluid flows and that is laminated on the first flat tube and arranged so that the flow direction of the high temperature fluid is parallel to the flow direction of the low temperature fluid. One of the first and second flat tubes is arranged in the direction of lamination. Ends of the flat tubes are bent in a direction intersecting at right angles both flow directions of the fluids and the direction of lamination.

31 Claims, 17 Drawing Sheets

U.S. PATENT DOCUMENTS

| | | | | |
|---|---|---|---|---|
| 2004/0104018 | A1 | 6/2004 | Hughes et al. | |
| 2004/0194938 | A1* | 10/2004 | Sasaki et al. | 165/164 |
| 2005/0067153 | A1* | 3/2005 | Wu et al. | 165/158 |
| 2005/0082048 | A1* | 4/2005 | Yoshida et al. | 165/164 |
| 2005/0198995 | A1 | 9/2005 | Lee | |
| 2006/0048928 | A1 | 3/2006 | Maezawa et al. | |

FOREIGN PATENT DOCUMENTS

| | | | |
|---|---|---|---|
| CN | 1436980 | A | 8/2003 |
| DE | 198 46 347 | A1 | 4/2000 |
| EP | 0 010 817 | A1 | 5/1980 |
| EP | 0 069 756 | A1 | 1/1983 |
| EP | 1 083 395 | A1 | 3/2001 |
| EP | 1 462 750 | A2 | 9/2004 |
| EP | 1 479 993 | A2 | 11/2004 |
| EP | 1 867 944 | A2 | 12/2007 |
| GB | 230922 | A | 3/1925 |
| JP | 62-155965 | U | 10/1987 |
| JP | 2-36768 | U | 3/1990 |
| JP | 2-55059 | U | 4/1990 |
| JP | 5-196377 | A | 8/1993 |
| JP | 2001-91074 | A | 4/2001 |
| JP | 2001-174083 | A | 6/2001 |
| JP | 2001-272184 | A | 10/2001 |
| JP | 2001-280751 | A | 10/2001 |
| JP | 2001-330390 | A | 11/2001 |
| JP | 2002-98424 | A | 4/2002 |
| JP | 2002-98486 | A | 4/2002 |
| JP | 2002-243374 | A | 8/2002 |
| JP | 2002-340485 | A | 11/2002 |
| JP | 2003-279275 | A | 10/2003 |
| JP | 2004-184074 | A | 7/2004 |
| JP | 2005-201536 | A | 7/2005 |
| JP | 2005-249314 | A | 9/2005 |
| JP | 2006-112756 | A | 4/2006 |
| JP | 2007-71511 | A | 3/2007 |
| WO | WO 2004/025207 | A1 | 3/2004 |

OTHER PUBLICATIONS

State Intellectual Property Office of the People's Republic of China; English translation of First Examination Report in Chinese Patent Application No. 21010286523.9 (Jun. 20, 2011).

Japanese Office Action, JP2010-166155, dated Dec. 20, 2011 with English language translation.

Official Action of Japanese Patent Office dated Jun. 5, 2012 for Japanese patent application 2010-166165 and English language translation of Official Action.

* cited by examiner

HEAT EXCHANGER AND REFRIGERATING AIR CONDITIONER

TECHNICAL FIELD

The present invention relates to a heat exchanger for performing a heat exchange between a low temperature fluid and a high temperature fluid to transmit heat from the high temperature fluid to the low temperature fluid. Further, the present invention relates to a refrigerating air conditioner using this heat exchanger.

BACKGROUND ART

A usual heat exchanger includes a first flat tube of a flat shape having a plurality of through holes in which a low temperature fluid flows, a second flat tube of a flat shape having a plurality of through holes in which a high temperature fluid flows, a first header connected to both ends of the first flat tube and a second header connected to both ends of the second flat tube. The first flat tube and the second flat tube are laminated under a state that the flat surfaces of the tubes respectively come into contact with each other so that the longitudinal directions (the flowing directions of the fluids) of the first flat tube and the second flat tube are parallel to each other. Thus, a high efficiency of a heat exchanging performance is obtained (for instance, see Patent Document 1)

Patent Document 1: JP-A-2002-340485 (Pages 4 to 5, FIG. 1)

DISCLOSURE OF THE INVENTION

Problems that the Invention is to Solve

In a refrigerating air conditioner using the above-described usual heat exchanger, a compressor, a heat radiator, a flow rate control unit and an evaporator are connected together by a refrigerant piping so as to circulate an HFC (hydrofluoro carbon) type refrigerant. However, since the HFC type refrigerant causes a global warming, recently, a refrigerant such as carbon dioxide having low global warming potential is employed in place thereof. However, when carbon dioxide is used as the refrigerant, a problem arises that the heat exchanging performance is extremely lower than that of the usual device.

In order to obtain the high efficiency of the heat exchanging performance in such a heat exchanger, the length (the length of the flowing direction of the fluid) or the width of the first flat tube and the second flat tube needs to be increased to obtain a larger contact area. Therefore, the heat exchanger is two-dimensionally enlarged. Further, when the flow rate of the low temperature fluid and the high temperature fluid is increased to improve the heat exchanging performance, the rise of a pressure loss due to the increase of flow velocity in the tubes needs to be suppressed. For the purpose thereof, an adjustment can be merely made in the direction of width, for instance, the adjustment is made to increase the width of the first flat tube and the second flat tube. Accordingly, when an adjustment is also made in the direction of length, the pressure loss cannot be adequately suppressed. Thus, a problem arises that a power of a driving device for supplying and circulating the fluid to the heat exchanger is increased.

Further, when the number of parallel passages is increased as in the case of increasing in the direction of width, when the fluid is distributed to the passages respectively by the first header and the second header, a biased flow rate due to the difference of a passage resistance is liable to arise. Especially, when the fluid is in a state of a two-phase flow of gas and liquid in which a gas phase is mixed with a liquid phase, a problem arises that a bias is generated in a gas and liquid ratio. As a result, the flow rate of the fluid that can be effectively heat exchanged is excessively insufficient, a temperature efficiency is extremely lowered, and the pressure loss is also increased to deteriorate the heat exchanging performance.

Further, in the usual heat exchanger disclosed in the above-described Patent Document, since the first header interferes with the second header, the first flat tubes and the second flat tubes are hardly laminated in multi-layers in the laminating direction to increase the contact areas.

The present invention is accomplished to solve the above-described problems and it is an object to provide a compact heat exchanger small in pressure loss of a fluid and having a high performance.

Further, it is an object of the present invention to obtain a compact refrigerating air conditioner having a high performance.

Means for Solving the Problems

A heat exchanger according to the present invention comprises: a first flat tube of a flat shape having a through hole in which a low temperature fluid flows; a second flat tube of a flat shape having a through hole in which a high temperature fluid flows; a first inlet header and a first outlet header respectively connected to both ends of the first flat tube; and a second inlet header and a second outlet header respectively connected to both ends of the second flat tube, wherein the first flat tube and the second flat tube are laminated and arranged with a plurality of laminated layers of three or more in such a way that the first flat tube and the second flat tube come into contact with each other on their flat surface and a flowing direction of the low temperature fluid intersects at right angles to a flowing direction of the high temperature fluid, wherein at least one of the first flat tube and the second flat tube includes a plurality of flat tubes arranged along the flat surface or arranged in the direction of a lamination, wherein the plurality of the flat tubes, and the inlet header and the outlet header respectively connected to both ends of the plurality of the flat tubes form parallel passages.

Further, a heat exchanger according to the present invention comprises: a first flat tube of a flat shape having a through hole in which a low temperature fluid flows; a second flat tube of a flat shape having a through hole in which a high temperature fluid flows; a first inlet header and a first outlet header respectively connected to both ends of the first flat tube; and a second inlet header and a second outlet header respectively connected to both ends of the second flat tube, wherein the first flat tube and the second flat tube are folded back in such a way that the first flat tube and the second flat tube come into contact with each other on their flat surfaces and a flowing direction of the low temperature fluid is parallel to a flowing direction of the high temperature fluid, and are laminated and arranged with a plurality of laminated layers of three or more.

Further, a heat exchanger according to the present invention comprises: a first flat tube of a flat shape having a through hole in which a low temperature fluid flows; a second flat tube of a flat shape having a through hole in which a high temperature fluid flows; a first inlet header and a first outlet header respectively connected to both ends of the first flat tube; and a second inlet header and a second outlet header respectively connected to both ends of the second flat tube, wherein the first flat tube and the second flat tube are laminated and arranged in such a way that the first flat tube and the second flat tube come into contact with each other on their flat surfaces and the flowing direction of the low temperature fluid is parallel to the flowing direction of the high temperature fluid, wherein at least one of the first flat tube and the second flat tube includes a plurality of flat tubes arranged in the direction of lamination, wherein both ends of the plurality of the flat tubes are bent in the direction intersecting at right angles to both the flowing direction of each fluid and the direction of lamination so that both ends of the first flat tube do not intersect both ends of the second flat tube, wherein the plurality of the flat tubes, and the inlet header and the outlet header respectively provided at both ends of the plurality of the flat tubes form parallel passages.

Further, a heat exchanger according to the present invention comprises: a first flat tube of a flat shape having a through hole in which a low temperature fluid flows; a second flat tube of a flat shape having a through hole in which a high temperature fluid flows; a first inlet header and a first outlet header respectively connected to both ends of the first flat tube; and a second inlet header and a second outlet header respectively connected to both ends of the second flat tube, wherein the first flat tube and the second flat tube are laminated so that the first flat tube and the second flat tube come into contact with each other on their flat surfaces, wherein the first flat tube or the second flat tube contains an aluminum alloy and each header is made of iron steel.

Further, a refrigerating air conditioner according to the present invention includes the heat exchanger of the present invention.

Advantages of the Invention

In the heat exchanger according to the present invention, since the first flat tube and the second flat tube are laminated and arranged with the number of laminated layers of three or more in such a way that the flowing directions of the fluids respectively intersect at right angles to each other, the heat exchanger is made to be compact without enlarging two-dimensionally. Further, since not only the direction of width, but also the direction of lamination of the first flat tube and the second flat tube can be increased, the flow rate of the low temperature fluid and the high temperature fluid is increased to enhance heat exchanging characteristics without increasing a pressure loss.

Further, since at least one flat tube of the first flat tube and the second flat tube is formed with the plurality of the flat tubes arranged along the flat surface or arranged in the direction of lamination, the flow rate of the fluid can be increased and the heat exchanging characteristics can be enhanced without increasing the pressure loss.

Further, either of the inlet header or the outlet header connected to the flat tubes forming the parallel passages is formed by the tubular header. When the plurality of the flat tubes forming the parallel passages are bundled and connected to the opened end of the tubular header so that the direction of an axis of the tubular header is the same as the flowing direction of the fluid in the plurality of the flat tubes forming the parallel passages, since the through holes of the flat tubes respectively in the opened end are substantially equally arranged relative to the fluid entering from or flowing out from the other opened end of the tubular header, a resistance difference of the passages to the through holes is decreased. Accordingly, since the fluid is uniformly distributed and mixed, the flow rate in the flat tubes respectively can be equalized and a heat exchanging performance is improved.

Further, in the heat exchanger according to the present invention, since the first flat tube and the second flat tube are folded back so that the flowing directions of the fluids are respectively parallel to each other, and laminated and arranged with the number of a plurality of laminated layers of three or more, the heat exchanger is made to be compact without enlarging two-dimensionally. Further, since not only the direction of width, but also the direction of lamination of the first flat tube and the second flat tube can be increased, the flow rate of the low temperature fluid and the high temperature fluid can be increased to enhance the heat exchanging characteristics without increasing the pressure loss.

Further, when at least one flat tube of the first flat tube and the second flat tube is formed with the plurality of the flat tubes arranged along the flat surface and the plurality of the flat tubes form the parallel passages, the flow rate of the fluid can be increased and the heat exchanging characteristics can be enhanced without increasing the pressure loss. Further, either of the inlet header or the outlet header connected to the flat tubes forming the parallel passages is formed by the tubular header. When the plurality of the flat tubes forming the parallel passages are bundled and connected to the opened end of the tubular header so that the direction of an axis of the tubular header is the same as the flowing direction of the fluid in the plurality of the flat tubes forming the parallel passages, since the through holes of the flat tubes respectively in the opened end are substantially equally arranged relative to the fluid entering from or flowing out from the other opened end of the tubular header, a resistance difference of the passages to the through holes is decreased. Accordingly, since the fluid is uniformly distributed and mixed, the flow rate in the flat tubes respectively can be equalized and the heat exchanging performance is improved.

Further, in the heat exchanger according to the present invention, since the first flat tube and the second flat tube are laminated and arranged so that the flowing directions of the fluids are respectively parallel to each other, the heat exchanger is made to be compact without enlarging two-dimensionally. Further, since not only the direction of width, but also the direction of lamination of the first flat tube and the second flat tube can be increased, the flow rate of the low temperature fluid and the high temperature fluid can be increased to enhance the heat exchanging characteristics without increasing the pressure loss.

Further, when at least one flat tube of the first flat tube and the second flat tube is formed with the plurality of the flat tubes arranged along the flat surface and the plurality of the flat tubes form the parallel passages, the flow rate of the fluid can be increased and the heat exchanging characteristics can be enhanced without increasing the pressure loss.

Further, since both ends of the plurality of the flat tubes are bent in the direction intersecting at right angles to both the flowing directions of the fluids and the direction of lamination so that both ends of the first flat tube and both ends of the second flat tube do not intersect with each other, even when the first flat tube and the second flat tube are alternately laminated so that the flowing directions are parallel to each other, the headers connected to both ends of the flat tubes do not interfere.

Further, either of the inlet header or the outlet header connected to the flat tubes forming the parallel passages is formed by the tubular header. When the plurality of the flat tubes forming the parallel passages are bundled and connected to the opened end of the tubular header so that the direction of an axis of the tubular header is the same as the flowing direction of the fluid in the plurality of the flat tubes forming the parallel passages, since the through holes of the flat tubes respectively in the opened end are substantially equally arranged relative to the fluid entering from or flowing out from the other opened end of the tubular header, a resistance difference of the passages to the through holes is decreased. Accordingly, since the fluid is uniformly distributed or mixed, the flow rate in the flat tubes respectively can be equalized and the heat exchanging performance is improved.

Further, in the heat exchanger according to the present invention, since the first flat tube or the second flat tube is made of the aluminum alloy and each header is made of the iron steel, a miniaturization and a low cost can be realized and the first flat tube and the second flat tube can be more relatively easily attached than an ordinarily used copper piping.

Still further, since a refrigerating air conditioner according to the present invention uses the heat exchanger of the present invention, a high performance and compact refrigerating air conditioner can be obtained.

DESCRIPTION OF REFERENCE NUMERALS AND SIGNS

Figure 1A:
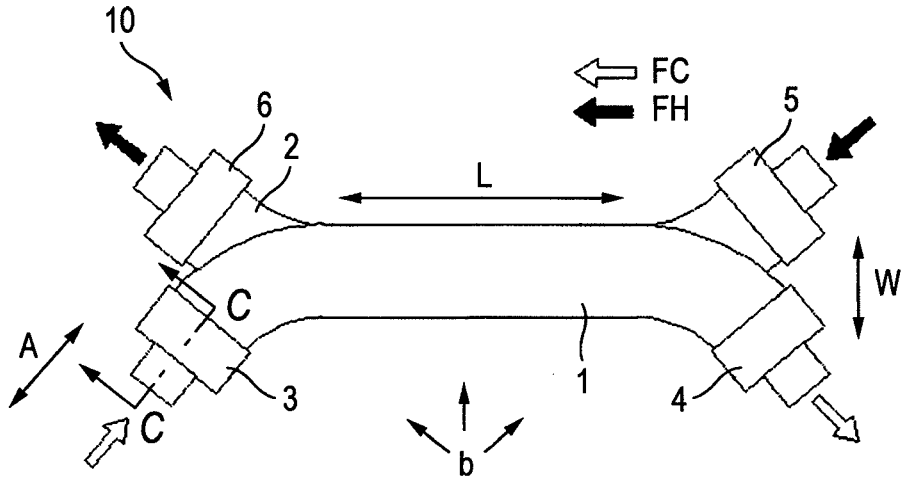
FIGS. 1A-1D are views showing a heat exchanger according to a first embodiment of the present invention.
Figure 1B:
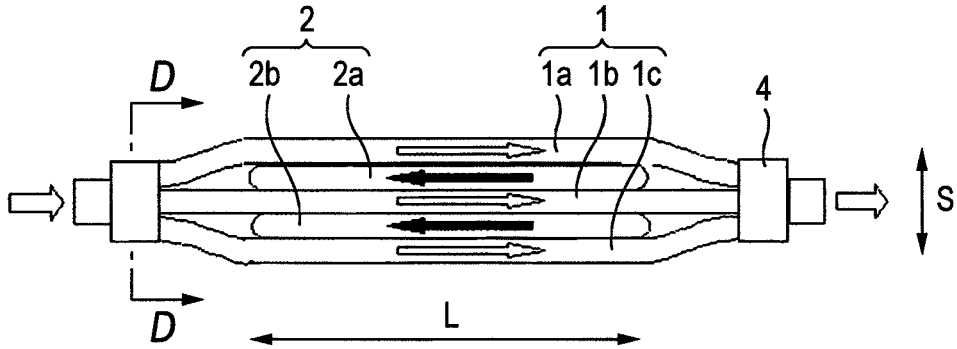

1: first flat tube, 2: second flat tube, 3: first inlet header, 4: first outlet header, 5: second inlet header, 6: second outlet header, 10: heat exchanger, 20: compressor, 21: heat radiator, 22: pressure reducing device, 23: cooler, 31: second pressure reducing device, 32: bypass piping, 33: injection port, 40: auxiliary compressor, 41: auxiliary heat radiator, 42: auxiliary pressure reducing device, 43: liquid reservoir, 50: inner wall, 51: orifice, 52: partition plate, 60: porous pipe, 61: first header body, 62: second header body, 611: first outlet pipe, 612: second inlet pipe, 613: first cover, 621: first inlet pipe, 622: second outlet pipe, 623: second cover, 631: first inner header, and 632: second inner header.

BEST MODE FOR CARRYING OUT THE INVENTION

First Embodiment

FIG. 1 is a view showing a heat exchanger 10 according to a first embodiment of the present invention. FIG. 1A is a front view. FIG. 1B is a side view in the direction of an arrow mark b in FIG. 1A. FIG. 1C is a sectional view on a line c-c of FIG. 1A. FIG. 1D is a sectional view on a line d-d of FIG. 1B.

In the drawing, a first flat tube 1 and a second flat tube 2 are alternately laminated and bonded by brazing or the like and have a plurality of through holes in which a low temperature fluid and a high temperature fluid respectively flow. The first flat tube and the second flat tube come into contact with each other on their flat surfaces, and the longitudinal directions (the flowing directions of the fluids with respect to the surface on which the first flat tube and the second flat tube come into contact with each other: a direction L) thereof are parallel to each other.

The first flat tube 1 includes three first flat tubes 1*a*, 1*b* and 1*c* arranged in the direction of lamination (a direction S) and the second flat tube 2 includes two second flat tubes 2*a* and 2*b* arranged in the direction of lamination (a direction S). Both ends of the first flat tubes 1*a*, 1*b* and 1*c* and both ends of the second flat tubes 2*a* and 2*b* are respectively bent by predetermined angles along flat surfaces so that both ends of the first flat tubes 1*a*, 1*b* and 1*c* are not overlapped on both ends of the second flat tubes 2*a* and 2*b* by viewing from the direction of lamination. That is, both end parts of the first flat tubes 1*a*, 1*b* and 1*c* and both end parts of the second flat tubes 2*a* and 2*b* are respectively bent in the direction (a direction W) intersecting at right angles to both the longitudinal direction (the direction L) and the direction of lamination (the direction S) in such a way that both ends of the first flat tube 1 and both ends of the second flat tube 2 do not respectively intersect with each other.

The first flat tubes 1*a*, 1*b* and 1*c* are connected to a first inlet header 3 and a first outlet header 4 at both end parts to form parallel passages.

The two second flat tubes 2*a* and 2*b* are connected to a second inlet header 5 and a second outlet header 6 at both end parts to form parallel passages.

A sectional area of the passage (a sectional area vertical to the flowing direction of the fluid) or the number of the through holes of the first flat tube 1 is made to be larger than that of the second flat tube 2. The total areas of the passages of the first flat tube 1 are larger than those of the second flat tube 2.

At least one of the first inlet header 3, the first outlet header 4, the second inlet header 5 and the second outlet header 6 is a tubular header of a tubular form having both ends opened (In FIG. 1, all headers are tubular headers). As shown in FIGS. 1C and 1D, the plurality of the flat tubes 1*a*, 1*b* and 1*c* (or 2*a* and 2*b*) forming the parallel passages are bundled and connected to the opened end of the tubular header so that the axial direction A of the tubular header is the same as the flowing direction of the fluid in the plurality of the flat tubes forming the parallel passages.

Figure 1C:
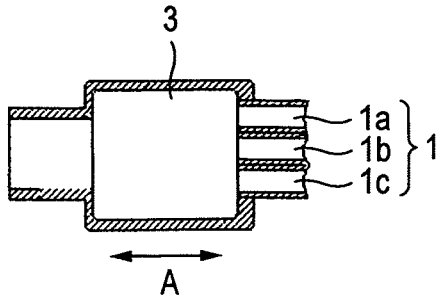
Figure 1D:
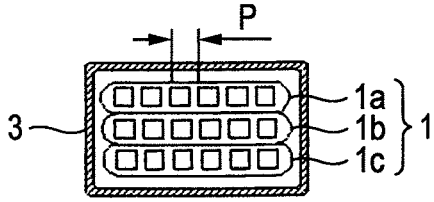

As shown in FIG. 1D, in this embodiment, the end parts of the plurality of the flat tubes 1*a*, 1*b* and 1*c* are bent in the direction of lamination, and laminated in the direction of the thickness of the flat tube and connected to the opened end of the tubular header.

In this embodiment, the first inlet header 3 is disposed so that the axial direction A is a vertical direction.

A material of the first flat tube 1 and the second flat tube 2 is an aluminum alloy of number of 1000s such as A1050or A1070, number of 3000s such as A3003 and number of 6000s. A material of each header is iron steel such as stainless steel or carbon steel. The first flat tube and the second flat tube are respectively bonded together to the headers by brazing.

In FIG. 1C, the tube ends of the flat tubes 1*a*, 1*b* and 1*c* are connected flush with an inner wall by viewing from the inner part of the tubular header, however, may be projected or retracted and connected.

According to the structure of this embodiment, both ends of the first flat tube and both ends of the second flat tube are bent along the flat surface, however, the ends of either one of the flat tubes may be bent along the flat surface so that both ends of the first flat tube and both ends of the second flat tube are not overlapped by viewing from the direction of lamination.

In this embodiment, as shown as an example, the first flat tube 1 includes the three flat tubes and the second flat tube 2 includes the two flat tubes. However, when one of the first flat tube and the second flat tube include a plurality of flat tubes, the number of the flat tubes does not need to be limited to the above-described number, and the first flat tube 1 and the second flat tube 2 may be laminated and arranged with the number of laminated layers of three or more.

Herein, an example is shown in which the through holes of the first flat tube 1 and the second flat tube 2 are provided in a row, however, the through holes do not need to be provided in a row and may be provided in a plurality of rows.

The form of the through hole is rectangular, however, may be circular and a protrusion can be formed in an inner surface to increase a heat transfer area and further improve heat exchanging characteristics.

It is to be understood that thin tubes having through holes may be arranged and used in place of the flat tubes to form a heat exchanger similar to that of this embodiment.

In FIG. 1, FC designates the flow of the low temperature fluid and FH designates the flow of the high temperature fluid. The low temperature fluid flows in the order of the first inlet header 3, the first flat tube 1, and the first outlet header 4. The high temperature fluid flows in the order of the second inlet header 5, the second flat tube 2 and the second outlet header 6. Both fluids exchange heat through the contact surface of the first flat tube 1 and the second flat tube 2.

According to the structure of this embodiment, since both ends of the first flat tube or the both ends of the second flat tube are bent along the flat surface so that both ends of the first flat tube and both ends of the second flat tube are not overlapped by viewing from the direction of lamination, even when the first flat tube and the second flat tube are alternately laminated so that flowing directions are parallel to each other, the first header connected to the first flat tube does not interfere with the second header connected to the second flat tube. Thus, the plurality of the flat tubes can be laminated in multilayers to increase a contact area. As a result, a heat exchanging performance can be improved and the heat exchanger can be made to be compact without enlarging two-dimensionally.

Since the first header does not interfere with the second header, the plurality of the first flat tubes and the plurality of the second flat tubes arranged in the direction of lamination can be formed as the parallel passages, the flow rate of the fluid can be increased and the heat exchanging characteristics can be enhanced without increasing a pressure loss. Further, it avoids increasing the power of a driving device for supplying and circulating the fluid to the heat exchanger.

Since the header connected to the flat tubes forming the parallel passages is the tubular header and the through holes of each flat tube in the opened end (a connecting part of the flat tube and the tubular header) of the tubular header are substantially equally arranged relative to the fluid entering or flowing out from the other opened end of the tubular header, a resistance difference of the passages to the through holes is decreased so that the fluid is uniformly distributed or mixed. Therefore, temperature efficiency can be maximized, the pressure loss can be minimized and the heat exchanging performance can be increased.

Since both ends of the first flat tube or the second flat tube are bent along the flat surface so that both ends of the first flat tube and both ends of the second flat tube are not overlapped by viewing from the direction of lamination and both ends of the plurality of the first flat tubes and both ends of the second flat tubes come relatively close to each other, when the flat tubes are connected to the tubular headers, the end parts of the flat tubes are bent in the direction of lamination, so that a piping for bundling the end parts of the flat tubes to one position can be easily managed to make the entire part of the heat exchanger compact.

Further, since the increase of a quantity of a refrigerant to be sealed and used can be suppressed, the compact heat exchanger having high environmental characteristics can provided.

According to the structure of this embodiment, since the flowing direction of the low temperature fluid can be opposed to the flowing direction of the high temperature fluid, the temperature efficiency can be increased and the heat exchanging performance can be improved.

In the embodiment shown in FIG. 1, in the first flat tube and the second flat tube, since the directions for bending both ends of the first flat tube and the second flat tube are opposite to each other relative to the direction W, the same flat tubes having the same bending angles at both ends can be used for the first flat tube and the second flat tube and inverted upward and downward and laminated. Accordingly, producing processes and a management can be simplified.

When the flow rate is increased to enhance the heat exchanging performance, to suppress the pressure loss, the inside diameter of the header needs to be enlarged so as to have a proper flow velocity. Accompanied therewith, to maintain a heat resistance, a thickness is increased and an outside diameter is extremely increased. However, since the header is formed with the iron steel having a high strength, the increase of the outside diameter can be suppressed to effectively miniaturize the entire part of the heat exchanger.

The iron steel such as the stainless steel or the carbon steel forming the header can be brazed and bonded to the aluminum alloy, copper, a copper alloy without generating a fragile compound layer having a low strength. Accordingly, the heat exchanger 10 can be relatively easily attached to copper piping ordinarily used in a domestic air conditioner or an air conditioner for business use by brazing.

Since the flat tube is made of the aluminum alloy, the flat tube can be relatively easily attached to the header by brazing or the like. Since the aluminum alloy can be produced by an extrusion molding process of a relatively low cost, a production cost can be suppressed.

Since the thickness can be further decreased in the aluminum alloy having a relatively high strength of number 3000s or number 6000s, a miniaturization and a low cost can be more realized.

Figure 2A:
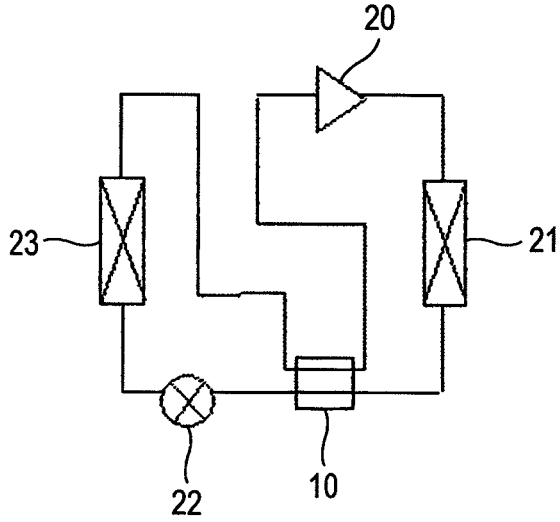
FIGS. 2A-2C are systematic views showing a refrigerating air conditioner using the heat exchanger according to the first embodiment of the present invention.
Figure 2B:
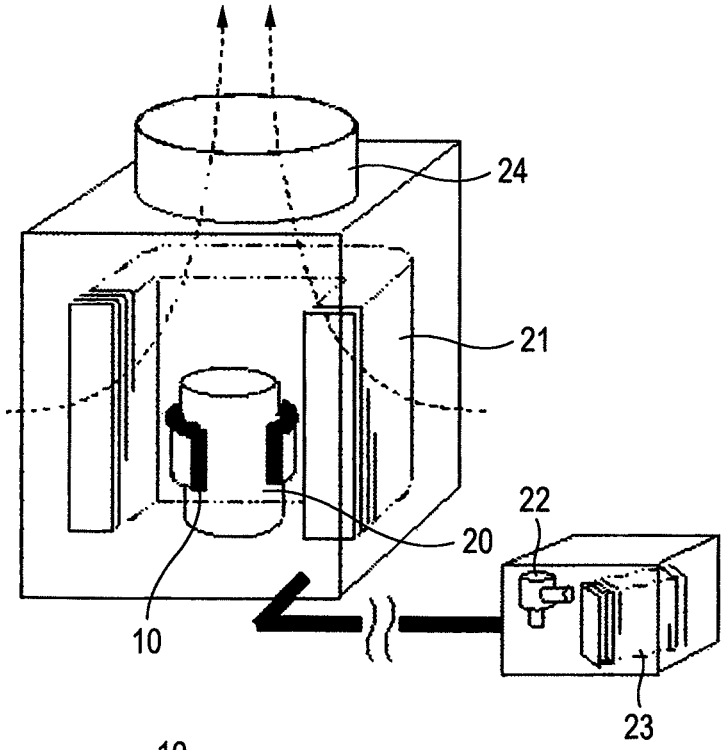
Figure 2C:
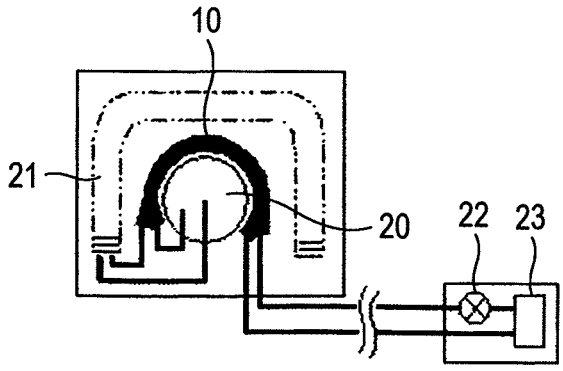

FIG. 2 is a view showing a refrigerating air conditioner using the heat exchanger of the first embodiment. FIG. 2A is a systematic diagram and FIGS. 2B and 2C respectively show a perspective view and a top view of an inner structure.

In FIG. 2A, a refrigerant circuit of this refrigerating air conditioner uses carbon dioxide as a refrigerant, and includes a compressor 20, a heat radiator 21, a pressure reducing device 22 and a cooler 23 connected in this order. The first inlet header 3 of the heat exchanger 10 is connected to the cooler 23, the first outlet header 4 is connected to the compressor 20, the second inlet header 5 is connected to the heat radiator 21 and the second outlet header 6 is connected to the pressure reducing device 22, respectively. Further, the first inlet header 3 is formed with the tubular header, and the first outlet header 4, the second inlet header 5 and the second outlet header 6 are formed with the tubular headers or branch headers whose axes intersect at right angles to the flat surfaces of the plurality of the flat tubes forming the parallel passages. In the case of the branch header, the plurality of the flat tubes are connected to the side surface of the header.

The refrigerant of vapor of low temperature and low pressure in the refrigerant piping of the compressor 20 is compressed by the compressor 20 and discharged as a supercritical fluid of high temperature and high pressure. This refrigerant is fed to the heat radiator 21, and the temperature of the refrigerant is lowered by exchanging heat with air, so that the refrigerant becomes the supercritical fluid of the high pressure. The refrigerant is cooled by the heat exchanger 10 to lower the temperature and enters to the pressure reducing device 22 to reduce the pressure so that the refrigerant is changed to a state of a two-phase flow of gas and liquid of the low temperature and the low pressure, and then fed to the cooler 23. The refrigerant exchanges heat with air in the cooler 23 and is evaporated to become refrigerant vapor of the low temperature and the low pressure and the refrigerant vapor is further heated in the heat exchanger 10 and returns to the compressor 20.

In FIGS. 2B and 2C, in the refrigerating air conditioner, an outdoor unit disposed outdoors and having the compressor 20, the heat radiator 21 and the heat exchanger 10 accommodated is connected to the pressure reducing device 22 and the cooler 23 disposed indoors by piping. Heat is radiated from the heat radiator 21 by the ventilation of a fan 24 of the outdoor unit.

Here, the heat exchanger 10 employs the heat exchanger of the above-described first embodiment. When the flat tubes are formed with a material relatively high in its ductility such as the aluminum alloy, copper and the copper alloy, or a thin flexible member, since the first flat tube 1 and the second flat tube 2 are bonded together on their flat surfaces in parallel with each other in the longitudinal direction (the direction L), and the headers are connected to both ends, the longitudinal directions can be freely bent in the direction of lamination relatively low in its rigidity. Accordingly, when the heat exchanger is mounted in the outdoor unit, as shown in the drawing, the heat exchanger can be arranged along the periphery of a shell of a vessel such as the compressor 20, or a space between the vessel and the piping can be effectively used and amounting efficiency to the device is improved, which contributes to the miniaturization of the entire part of the device.

Figure 3:
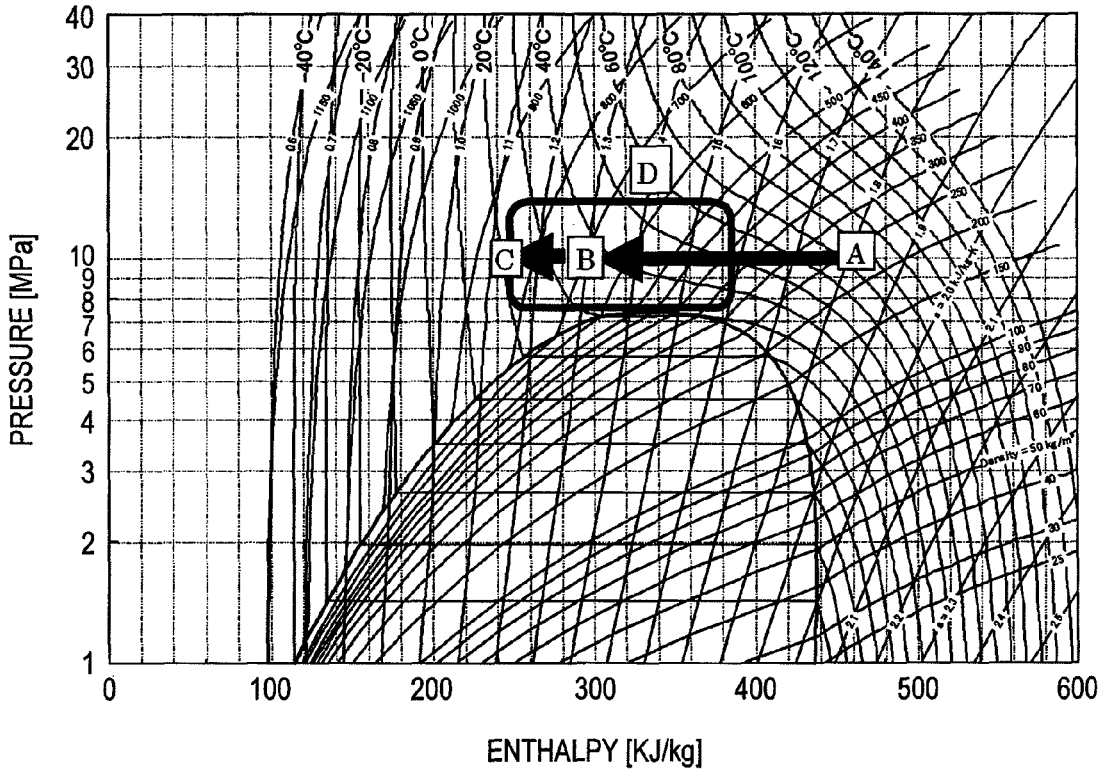
FIG. 3 is a pressure-enthalpy diagram of carbon dioxide for explaining the operation of the heat exchanger of the first embodiment of the present invention.

FIG. 3 is a pressure-enthalpy diagram of carbon dioxide. In the drawing, a point A shows a state of the refrigerant in the inlet of the heat radiator, a point B shows a state of the refrigerant in the outlet of the heat radiator, and a point C shows a state of the refrigerant in the inlet of the pressure reducing device. When the carbon dioxide is used as the refrigerant of the refrigerating air conditioner and the heat is radiated at a critical point or higher, the heat is exchanged in an area (an area surrounded by a thick line D in the drawing) extremely high in its specific heat in the vicinity of the critical point, so that an efficiency can be greatly improved. When outside air temperature is high, the outlet temperature of the heat radiator 21 cannot be adequately lowered. However, since the refrigerant of low temperature including the refrigerant liquid of the outlet of the cooler 23 efficiently cools the refrigerant supplied to the inlet of the pressure reducing device 22 from the outlet of the heat radiator 21 in the heat exchanger 10, the temperature of the refrigerant in the inlet of the pressure reducing device 22 can be sufficiently lowered.

In the heat exchanger 10, the pressure loss generated when the refrigerant of the low temperature in a gas-liquid two-phase state including the refrigerant liquid flows in the first flat tube 1 is larger than the pressure loss generated when the refrigerant of the high temperature and the high pressure under a supercritical state flows in the second flat tube 2. However, since the sectional areas or the number of the passages of the through holes of the first flat tube 1 are larger than those of the second flat tube 2, the flow velocity in the first flat tube 1 can be suppressed. Thus, a proper pressure loss can be maintained. Further, since the flat tubes are not enlarged in the direction of length to increase a contact area, the pressure loss can be properly maintained.

Since the first inlet header 3 is formed with the tubular header and the gas-liquid two-phase refrigerant enters the first inlet header 3, the resistance difference of the passages to the through holes is low. Accordingly, the refrigerant is apt to be appropriately distributed. In addition thereto, the gas and liquid are mixed in the header so that the gas-liquid ratio of the fluid supplied respectively to the through holes can be equalized.

Further, since the first inlet header 3 formed with the tubular header is arranged so that the direction of its axis is directed to a vertical direction, a difference does not arise in gravity acting on the fluid supplied respectively to the through holes. Accordingly, an influence given to the gas-liquid ratio can be suppressed. Therefore, the temperature efficiency of the fluid can be maximized, the pressure loss can be minimized and the heat exchanging performance can be increased.

When the second inlet header 5 is formed with the tubular header and the gas-liquid two-phase refrigerant enters the second inlet header 5, the same effects are realized in the second inlet header 5.

Figure 4:
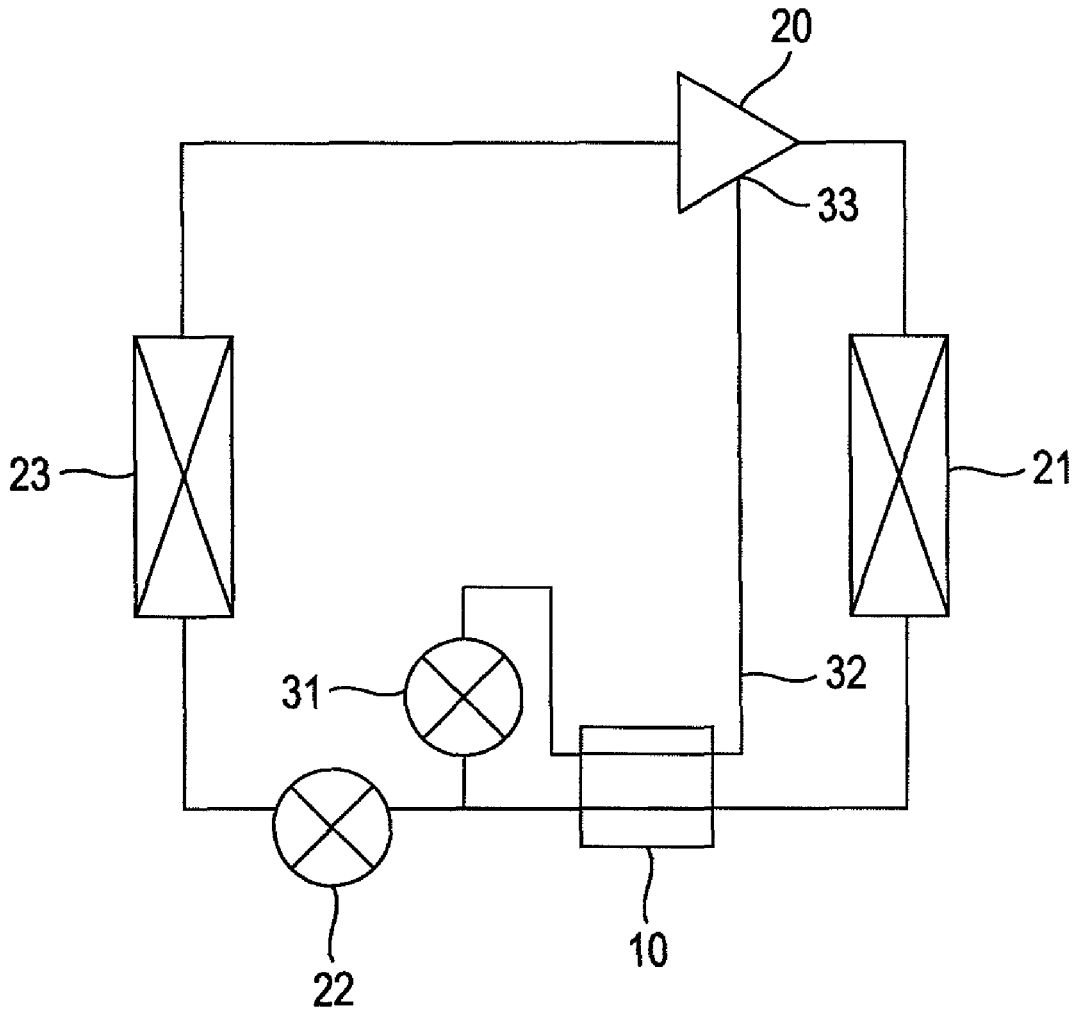
FIG. 4 is a systematic diagram showing another refrigerating air conditioner using the heat exchanger according to the first embodiment of the present invention.

FIG. 4 is a systematic diagram of another refrigerant air conditioner using the heat exchanger of the first embodiment. A refrigerant circuit includes a compressor 20, a heat radiator 21, a pressure reducing device 22 and a cooler 23 connected in this order and a bypass piping 32 has one end connected between the heat radiator 21 and the pressure reducing device 22 and the other end connected to an injection port 33 provided in the halfway part of a compressing process of a refrigerant in the compressor 20. A second pressure reducing device 31 is provided in the intermediate part of the bypass piping 32. The first inlet header 3 (the tubular header) of the heat exchanger 10 is connected to the second pressure reducing device 31, the first outlet header 4 is connected to the injection port 33, the second inlet header 5 is connected to the heat radiator 21 and the second outlet header 6 is connected to the pressure reducing device 22.

A refrigerant whose pressure is reduced in the second pressure reducing device 31 is changed to a state of a gas-liquid two-phase flow of low temperature, passes the heat exchanger 10 and is fed to the injection port 33 of the compressor 20. In the heat exchanger 10, since the refrigerant of low temperature including refrigerant liquid from the outlet of the second pressure reducing device 31 efficiently cools the refrigerant supplied from the outlet of the heat radiator 21 to the inlet of the pressure reducing device 22, the temperature of the refrigerant in the inlet of the pressure reducing device 22 can be sufficiently lowered similarly to the refrigerating air conditioner shown in FIG. 2.

Figure 5A:
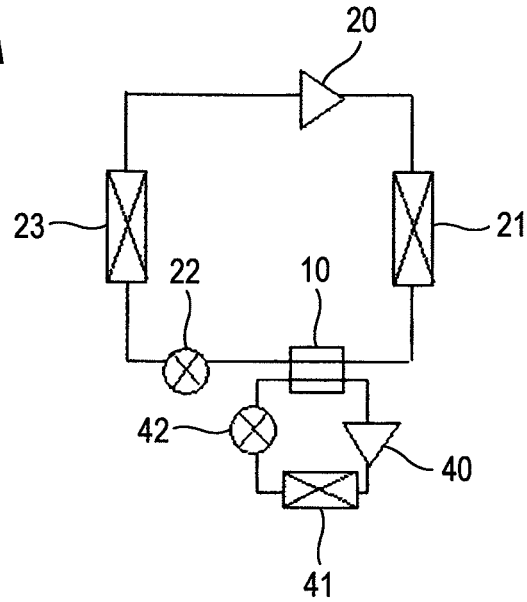
FIGS. 5A-5C are systematic diagrams showing still another refrigerating air conditioner using the heat exchanger according to the first embodiment of the present invention.
Figure 5B:
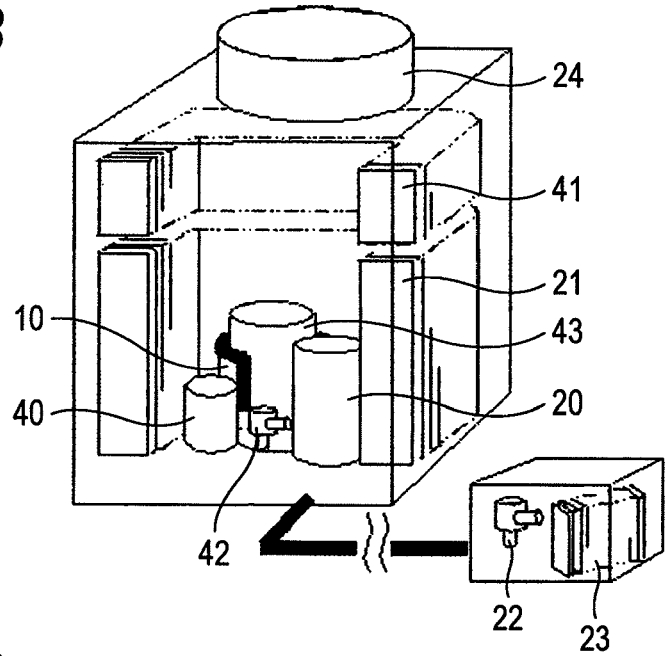
Figure 5C:
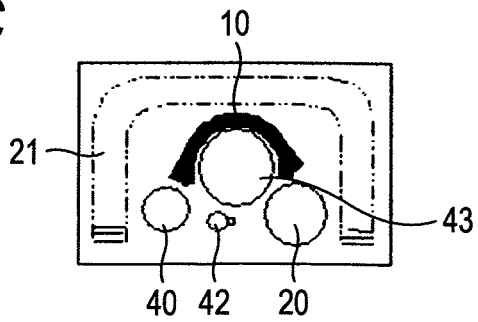

FIG. 5 is a view showing a still another refrigerating air conditioner using the heat exchanger of the first embodiment. FIG. 5A is a systematic diagram and FIGS. 5B and 5C respectively show a perspective view and a top view of an inner structure.

In FIG. 5A, a refrigerant circuit of this refrigerating air conditioner is a refrigerant circuit including a compressor 20, a heat radiator 21, a pressure reducing device 22 and a cooler 23 connected in this order. The second inlet header 5 (the tubular header) of the heat exchanger 10 is connected to the heat radiator 21 and the second outlet header 6 is connected to the pressure reducing device 22. Further, a second refrigerant circuit is provided in which the first outlet header 4, an auxiliary compressor 40, an auxiliary condenser 41, an auxiliary pressure reducing device 42 and the first inlet header 3 are sequentially connected. The second refrigerant circuit is designed to operate in a vapor compression type refrigerating cycle using an HFC type refrigerant, an HC type refrigerant or ammonia.

The refrigerant whose pressure is reduced in the auxiliary pressure reducing device 42 is changed to a state of a gas-liquid two-phase flow of low temperature, passes the heat exchanger 10 and returns to the auxiliary compressor 40. In the heat exchanger 10, since the refrigerant of low temperature including refrigerant liquid from the outlet of the auxiliary pressure reducing device 42 efficiently cools the refrigerant supplied from the outlet of the heat radiator 21 to the inlet of the pressure reducing device 22, the temperature of the refrigerant in the inlet of the pressure reducing device 22 can be sufficiently lowered similarly to the refrigerating air conditioner shown in FIGS. 2 and 3.

In FIGS. 5B and 5C, in the refrigerating air conditioner, an outdoor unit disposed outdoors and having the compressor 20, the heat radiator 21, the auxiliary compressor 40, the auxiliary condenser 41, the auxiliary pressure reducing device 42 and the heat exchanger 10 accommodated is connected to the pressure reducing device 22 and the cooler 23 disposed indoors by piping. Heat is radiated from the heat radiator 21 by the ventilation of a fan 24 of the outdoor unit.

Here, the heat exchanger 10 employs the heat exchanger of the above-described first embodiment. When the flat tubes are formed with a material relatively high in its ductility such as the aluminum alloy, copper and the copper alloy, or a thin flexible member, since the first flat tube 1 and the second flat tube 2 are bonded together on their flat surfaces in parallel with each other in the longitudinal direction (the direction L), and the headers are connected to both ends, the longitudinal directions can be freely bent in the direction of lamination relatively low in its rigidity. Accordingly, when the heat exchanger is mounted in the unit, the heat exchanger can be arranged along the periphery of a shell of a vessel such as the compressor, like FIGS. 2B and 2C or a space between the vessel and the piping can be effectively used and a mounting efficiency to the device is improved, which contributes to the miniaturization of the entire part of the device.

In an example shown in FIGS. 5B and 5C, in the unit in which a liquid reservoir 43 for adjusting an amount of the refrigerant in the refrigerant circuit to a suitable amount is added as well as the compressor 20 and the auxiliary compressor 40, the heat exchanger 10 is disposed around the liquid reservoir 43. As the number of vessels is more increased, the degree of freedom of an installation space is increased, which contributes to the improvement of the mounting efficiency.

In FIG. 5, the refrigerating air conditioner can be applied to a secondary loop type refrigerating air conditioner in which the heat radiator 21 may be omitted and all gas of high temperature and high pressure discharged from the compressor 20 is cooled in the heat exchanger 10. In this case, in the heat exchanger 10, since a necessary amount of heat exchange is increased so that a rate of volume thereof occupied in the entire part of the refrigerating air conditioner is relatively increased, the heat exchanger 10 is effectively more compact.

The refrigerating air conditioners shown in FIGS. 2, 4 and 5 can be applied to a room air conditioner, a package air conditioner, a hot water supply device and a fixed refrigerating air conditioner such as a refrigerating machine.

As described above, in the refrigerating air conditioner using the heat exchanger of this embodiment, at least one of the low temperature fluid and the high temperature fluid respectively flowing in the first flat tube and the second flat tube of the heat exchanger is the fluid of the gas-liquid two-phase state. The first inlet header or the second inlet header in which the fluid of the gas-liquid two-phase state flows is formed with the tubular header. In the outlet end of the tubular header, the laminated flat tubes are bundled and connected to one part. Accordingly, since the resistance difference of the passages to the through holes respectively is small, the fluid is liable to be properly distributed. Further, the gas and the liquid are mixed in the tubular header so that the gas-liquid ratio of the fluid supplied respectively to the through holes can be equalized.

Since the tubular header is arranged so that the direction of an axis is directed to the vertical direction, the difference does not arise in the gravity acting on the fluid supplied respectively to the through holes. Thus, the fluid can be appropriately supplied to the through holes of the flat tube so that the temperature efficiency of the fluid can be maximized, the pressure loss can be minimized and the performance of the heat exchanger can be increased.

Since, for the refrigerating air conditioner using carbon dioxide as the refrigerant, the high temperature fluid flowing in the second flat tube of the heat exchanger is the supercritical fluid of the high temperature and the high pressure and the low temperature fluid flowing in the first flat tube is the gas-liquid two-phase fluid, the heat exchanger can be optimized to meet the conditions of the heat exchanger such as conditions of the temperature or the flow rate, the performance of the heat exchanger can be maximized, and accordingly, the performance of the device can be improved.

Since the heat exchanger can be made to be compact and the increase of a quantity of the refrigerant to be sealed can be restricted, the compact refrigerating air conditioner having high environmental characteristic can be provided.

Since the number of the laminated layers of the flat tubes (the number of the parallel passages by the flat tubes) can be changed depending on the kinds of the low temperature fluid and the high temperature fluid, the temperature efficiency of the fluids respectively flowing in the flat tubes can be maximized, further, the pressure loss can be minimized and the heat exchanging performance can be increased. Further, the increase of a power of the driving device for supplying and circulating the fluid to the heat exchanger can be suppressed.

In the first flat tube and the second flat tube, at least one of the number of the through holes, the sectional area of the passages and the arrangement pitch P thereof is changed, so that the temperature efficiency of the fluids respectively passing the through holes can be maximized, further, the pressure loss can be minimized and the heat exchanging performance can be increased. Further, the increase of the power of the driving device for supplying and circulating the fluid to the heat exchanger can be suppressed.

Second Embodiment

Figure 6A:
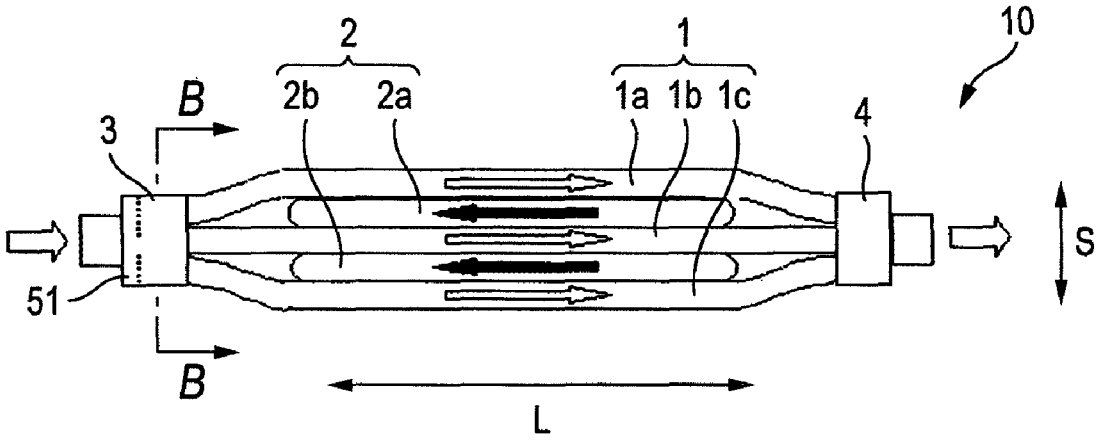
FIGS. 6A and 6B are views showing a heat exchanger according to a second embodiment of the present invention.
Figure 6B:
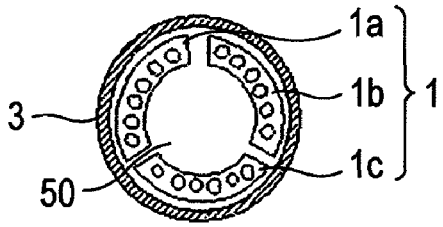

FIG. 6A is a view showing a heat exchanger 10 according to a second embodiment of the present invention. FIG. 6A is a side view seen from the same direction as that of FIG. 1B. FIG. 6B is a sectional view on a line b-b of FIG. 6A.

In the drawing, at least one of a first inlet header 3, a first outlet header 4, a second inlet header 5 (an illustration is omitted) and a second outlet header 6 (an illustration is omitted) is a tubular header of a tubular form having both ends opened (In FIG. 6, all headers are tubular headers).

As shown in FIG. 6B, end parts of a plurality of flat tubes 1*a*, 1*b* and 1*c* are bent in circular arc shapes and arranged in an annular form and connected to the opened end of the tubular header. At a central part of the opened end, an inner wall 50 is formed.

The tube ends of the flat tubes may be connected flush with from the inner wall, may be projected or retracted and connected, by viewing from the inner part of the tubular header.

In a part between both opened ends of the first inlet header 3, that is, in the inner part of the first inlet header 3, an orifice 51 is provided that has a sectional area of a passage smaller than sectional areas of passages before and behind the passage. Since other structures are the same as those of the first embodiment, an explanation is omitted.

According to such a structure, not only the resistance of the passages to the through holes of the flat tubes can be equalized, but also a resistance difference of the passages to the through holes respectively is relatively decreased by the resistance of the passage of the orifice 51, so that a refrigerant is more equally distributed. Therefore, the temperature efficiency of a fluid can be maximized, a pressure loss can be minimized and the performance of the heat exchanger can be more increased.

When the orifice 51 is provided not only in the first inlet header 3, but also in other header, the same effects can be obtained.

Figure 7:
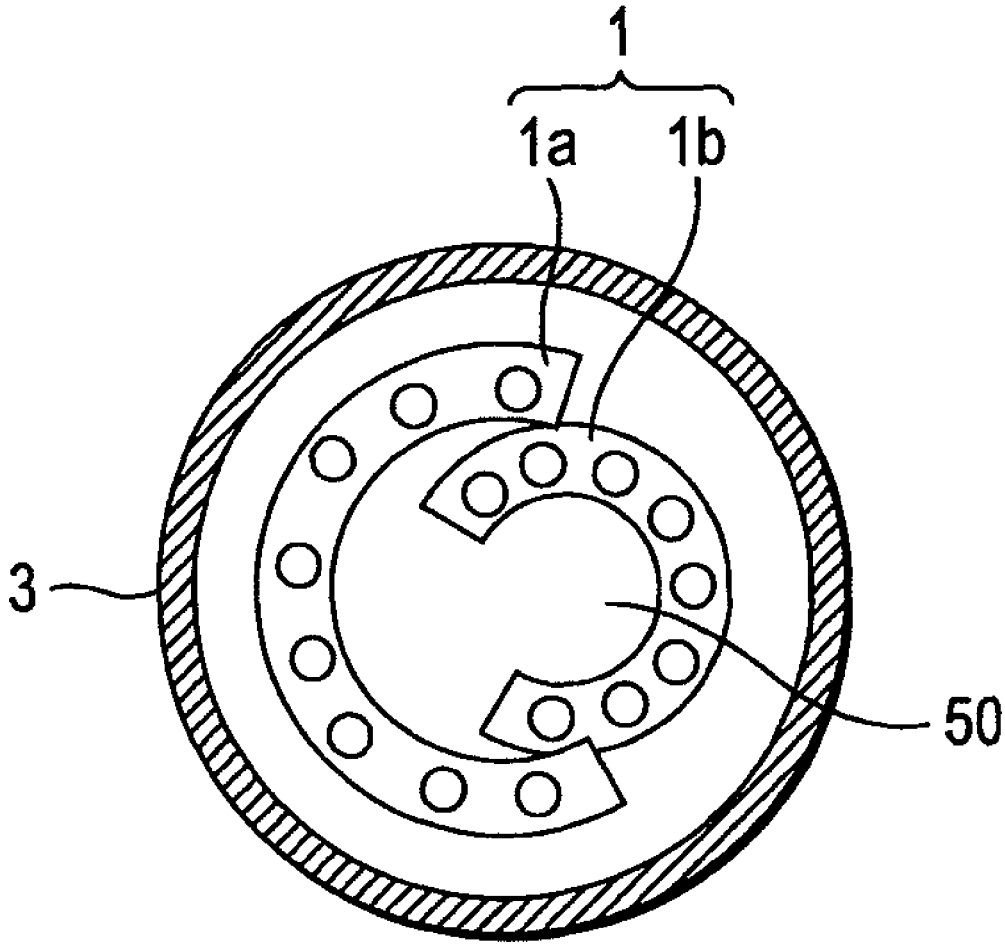
FIG. 7 is a view showing another tubular header according to the second embodiment of the present invention.
Figure 8A:
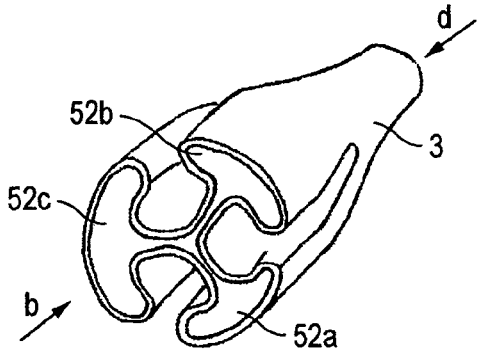
FIGS. 8A-8D are views showing still another tubular header according to the second embodiment of the present invention.
Figure 8B:
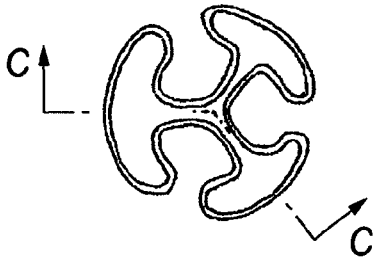
Figure 8C:
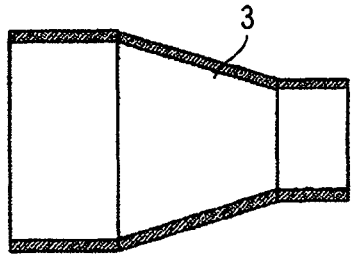
Figure 8D:
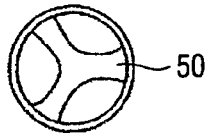

The bent end parts of the flat tubes connected to the outlet of the tubular header may not be arranged in one row of the annular form, but may be overlapped so that the end parts are partly superposed each other as shown in FIG. 7. In this case, the diameter of the tubular header can be reduced and made to be more compact.

In FIG. 7, the first flat tube is formed with the two flat tubes 1*a* and 1*b*, however, the number may be one or three or more.

FIG. 8 shows a tubular header formed from a straight pipe by a drawing working or a press working. FIG. 8A is a perspective view showing the first inlet header 3 viewed from an outlet side. FIG. 8B is a rear view seen from the direction of an arrow mark b of FIG. 8A. FIG. 8C is a sectional view on a line c-c of FIG. 8B. FIG. 8D is a front view seen from the direction of an arrow mark d of FIG. 8A.

In the tubular header shown in FIG. 8, an outer periphery of the pipe is deformed in a radial direction at one end to provide opened parts 52*a*, 52*b* and 52*c* to which the flat tubes are connected and central parts are connected to form the inner wall 50.

The tubular header is formed in such a way, so that the structure of the header can be simplified and made to be more compact and a production process can be extremely simplified.

Figure 9:
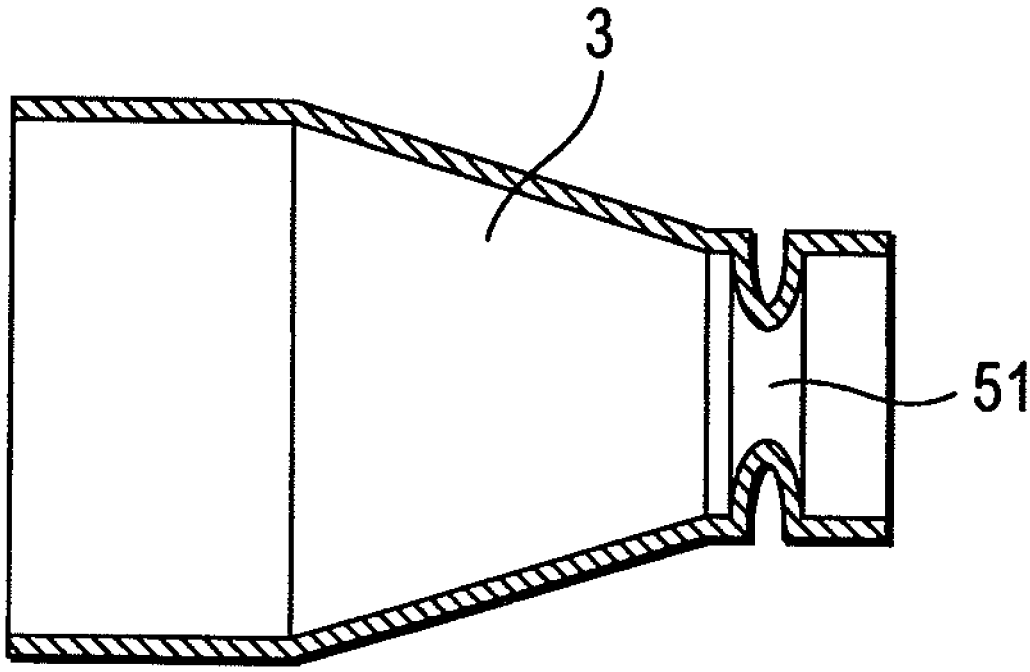
FIG. 9 is a view showing still another tubular header according to the second embodiment of the present invention.

FIG. 9 shows a tubular header having an orifice 51 provided therein that is formed integrally. Thus, a cost is low and the distributing characteristics of the fluid to the through holes of the flat tubes respectively can be more improved.

In FIG. 9, the flat tubes are connected to the opened end in a left side.

When a gas-liquid two-phase refrigerant enters the second inlet header 5, the same effects are realized in the second inlet header 5.

The heat exchanger of the second embodiment can be employed in all the refrigerating air conditioners shown in FIGS. 2, 4 and 5. When the low temperature fluid of a gas-liquid two-phase state enters the first inlet header 3, as shown in FIG. 68, since the fluid entering the first inlet header 3 collides with the inner wall 50 in the central part of the outlet end of the header to urge the gas and liquid to be mixed, expands in the radial direction and enters the through holes arranged in the annular form, the gas-liquid ratio of the fluid supplied respectively to the through holes can be more equally distributed without depending on an operating condition or an attitude.

Further, the flow velocity of the fluid is accelerated by the orifice 51 so that the fluid can collide with the central part, the mixing of the gas and liquid can be more accelerated at the time of increasing the flow velocity or collision, an equal distribution to the through holes can be enhanced, the temperature efficiency of the fluid can be maximized, a pressure loss can be minimized and the performance of the heat exchanger can be increased.

Third Embodiment

Figure 10A:
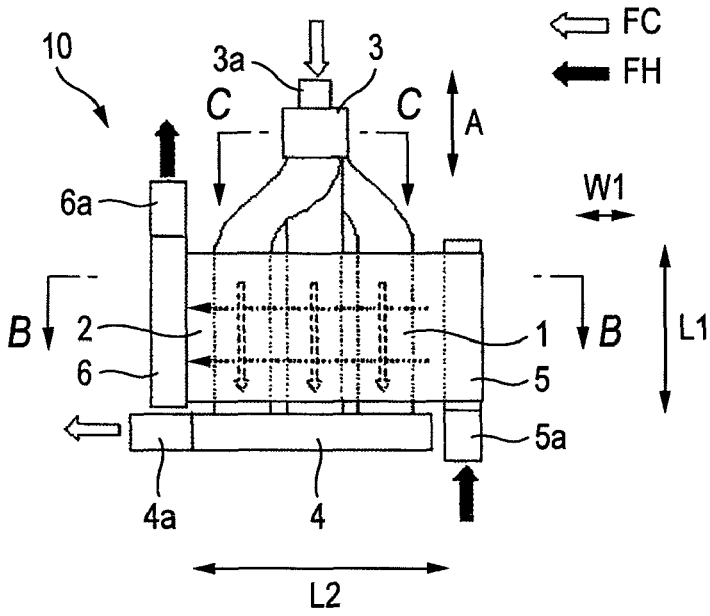
FIGS. 10A-10C are views showing a heat exchanger according to a third embodiment of the present invention.
Figure 10B:
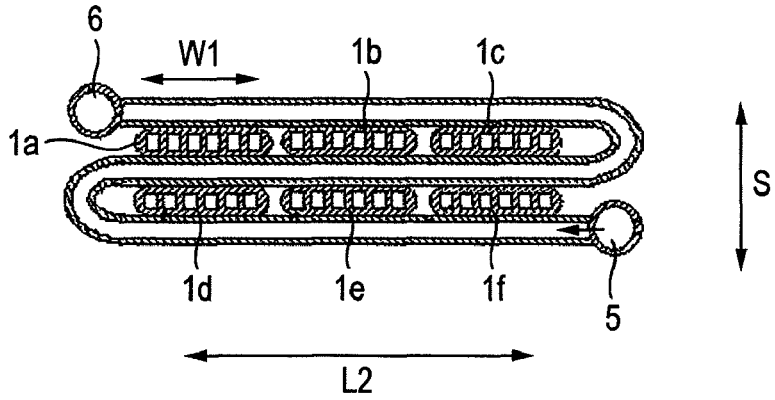
Figure 10C:
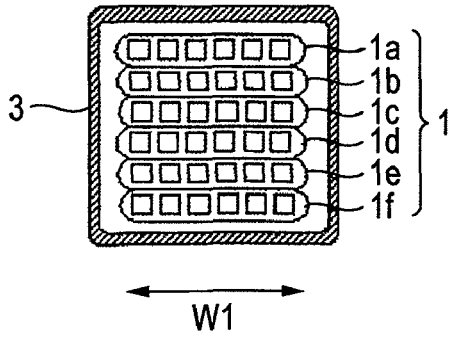

FIG. 10 is a view showing a heat exchanger 10 according to a third embodiment of the present invention. FIG. 10A is a front view. FIG. 10B is a sectional view on a line b-b of FIG. 10A. FIG. 10C is a sectional view on a line c-c of FIG. 10A.

In the drawing, a first flat tube 1 and a second flat tube 2 have a plurality of through holes in which a low temperature fluid and a high temperature fluid respectively flow, are alternately laminated and bonded by brazing or the like so that the first flat tube and the second flat tube come into contact with each other on their flat surfaces and the longitudinal directions (the flowing directions of the fluids on the surface on which the first flat tube and the second flat tube come into contact with each other: a direction L1 and a direction L2) thereof respectively intersect at right angles to each other.

The first flat tube 1 includes six flat tubes 1*a*, 1*b*, 1*c*, 1*d*, 1*e* and 1*f*. The flat tubes 1*a*, 1*b* and 1*c* and the flat tubes 1*d*, 1*e* and 1*f* are respectively arranged along the flat surfaces and in the direction of width of the flat tube 1 (a direction intersecting at right angles to the flowing direction: a direction W1). Further, the flat tubes 1*a*, 1*b*, and 1*c* and the flat tubes 1*d*, 1*e* and 1*f* are arranged in the direction of lamination (a direction S). Further, the upper and lower ends of the flat tubes 1*a*, 1*b*, 1*c*, 1*d*, 1*e* and 1*f* are respectively connected to a first inlet header pipe 3 and a first outlet header 4 to form parallel passages.

The second flat tube 2 is folded back in the longitudinal direction (the direction L2) so that three stages or layers are laminated, and both ends are respectively connected to a second inlet header 5 and a second outlet header 6.

A total area of the passages of the first flat tube 1 is made to be larger than a total area of the passages of the second flat tube 2.

The length of the longitudinal direction (the direction L1) of the first flat tube is made to be shorter than the length of the longitudinal direction (the direction L2) of the second flat tube.

In FIG. 10, the sectional areas or the number of the passages of the through holes of the six first flat tubes are completely the same, however, the sectional areas or the number of the passages of the through holes may be increased the more in the flat tube that comes into contact with the outlet side of the second flat tube 2.

Similarly, the sectional areas or the number of the passages of the through holes of the second flat tube 2 may be increased the more in the flat tube that comes into contact with the inlet side of the first flat tube 1.

As shown in FIG. 10C, the first inlet header 3 is a tubular header shown in the first embodiment and the second embodiment. The first outlet header 4, the second inlet header 5 and the second outlet header 6 are headers that respectively connect the flat tubes to the side surfaces of the headers so that the axial directions of the headers are parallel to the flat surfaces of the flat tubes.

Further, the headers 3 to 6 are respectively connected to connecting piping 3*a*, 4*a*, 5*a* and 6*a*.

A material of the first flat tube 1 and the second flat tube 2 is an aluminum alloy of number of 1000s such as A1050 or A1070, number of 3000s such as A3003 and number of 6000s. A material of each header 3 to 6 is iron steel such as stainless steel or carbon steel. A material of the connecting piping 3*a* to 6*a* is copper or a copper alloy and the headers are respectively bonded to the connecting piping by brazing or the like.

In this embodiment, the first inlet header 3 is arranged so that a direction of an axis A is directed to a vertical direction.

In FIG. 10, FC designates the flow of the low temperature fluid and FH designates the flow of the high temperature fluid. The low temperature fluid flows in the order of the first inlet header 3, the first flat tube 1, and the first outlet header 4. The high temperature fluid flows in the order of the second inlet header 5, the second flat tube 2 and the second outlet header 6. Both fluids exchange heat through the contact surface of the first flat tube 1 and the second flat tube 2.

In order to increase a heat exchanging performance, a contact area needs to be increased. In this embodiment, since the first flat tube and the second flat tube are laminated and arranged so that the flowing directions of the fluids respectively intersect at right angles to each other, the contact area of the first flat tube and the second flat tube can be increased without enlarging the heat exchanger tow-dimensionally. Since the flowing directions of the fluids respectively intersect at right angles to each other, the headers connected respectively to the flat tubes do not interfere with each other. As a result, a compact structure is obtained and a process necessary when the flat tubes or the headers are bonded by brazing during a production can be simplified.

In this embodiment, since the first flat tube and the second flat tube are laminated and arranged so that the flowing directions of the fluids respectively intersect at right angles to each other, the first header connected to the first flat tube does not interfere with the second header connected to the second flat tube. Accordingly, the plurality of the flat tubes can be also laminated in multi-layers in the direction of lamination to increase the contact area. As a result, the heat exchanging performance can be enhanced and the heat exchanger can be made to be compact without enlarging two-dimensionally.

Since the width or the length of the first flat tube can be made to be different from the width or the length of the second flat tube, the length and the width of the flat tubes can be changed depending on the kinds of the low temperature fluid and the high temperature fluid, the temperature efficiency of the fluids can be maximized, a pressure loss can be minimized, the heat exchanging performance can be increased and the increase of the power of a driving device for supplying and circulating the fluid to the heat exchanger can be suppressed.

Since the first flat tube or the second flat tube is formed with a plurality of flat tubes (in FIG. 10, only the first flat tube) to from the parallel passages, the flow rate of the fluid can be increased without increasing the pressure loss and the heat exchanging performance can be enhanced. The power of the driving device for supplying and circulating the fluid to the heat exchanger is not increased.

Since either the inlet header or the outlet header connected to the flat tubes forming the parallel passages is the tubular header (in FIG. 10, only the first inlet header 3), and the plurality of the flat tubes forming the parallel passages are bundled and connected to the opened end of the tubular header so that the direction of the axis of the tubular header is the same as the flowing direction of the fluid in the plurality of the flat tubes forming the parallel passages, the through holes of the flat tubes in the opened end are substantially equally arranged relative to the fluid entering or flowing out from the other opened end of the tubular header. Thus, a resistance difference of the passages to the through holes is small and the fluid is uniformly distributed or mixed, so that the flow rate respectively in the flat tubes can be equalized and the heat exchanging performance is improved.

Further, since the plurality of the flat tubes arranged along the flat surfaces or both ends thereof respectively come relatively close to each other, when the flat tubes are connected to the tubular headers, the end parts of the flat tubes are respectively bent along the flat surfaces and in the direction of lamination. Thus, a piping for bundling the end parts of the flat tubes to one position can be easily managed to make the entire part of the heat exchanger compact.

Further, since both end parts of the plurality of the flat tubes arranged in the direction of lamination respectively come relatively close to each other, when the flat tubes are connected to the tubular headers, the end parts of the flat tubes are respectively bent in the direction of lamination. Thus, a piping for bundling the end parts of the flat tubes to one position can be easily managed to make the entire part of the heat exchanger compact.

Further, the connecting piping 3*a* to 6*a* made of copper or the copper alloy are provided so that the headers can be more easily attached to an external copper piping.

In this embodiment, the tubular header is applied to the first inlet header 3, however, a tubular header may be applied to the first outlet header 4.

Further, in this embodiment, the heat exchanger is shown in which the six first flat tubes 1 and five layers laminated in the direction of lamination by folding back one second flat tube 2. However, the number of the first flat tubes arranged in the direction of lamination and the number of the first flat tubes arranged along the flat surface are not limited to the number of this embodiment.

The parallel passages may be formed by the plurality of the first flat tubes arranged only in the direction of lamination, or the parallel passages may be formed only by the plurality of the first flat tubes arranged along the flat surface and the plurality of the first flat tubes arranged along the flat surface may be folded back in the direction of lamination.

The second flat tubes 2 may have the same structure as that of the first flat tubes 1. Both first flat tubes and the second flat tubes may be arranged along the flat surface or arranged in the direction of lamination to form the parallel passages.

When the second flat tubes 2 form the parallel passages, the second inlet header 5 or the second outlet header 6 may be preferably a tubular header like the first flat tube 1.

Herein, an example is shown in which the through holes of the first flat tube 1 and the second flat tube 2 are formed in one row, however, the through holes do not need to be formed in one row and may be formed in a plurality of rows.

The form of the through hole is rectangular, however, the form of the through hole may be circular and a protrusion can be formed in an inner surface to increase a heat transfer area and more improve heat exchanging characteristics.

In this embodiment, the tubular header similar to that of the first embodiment is applied to the first inlet header. However, the end parts of the plurality of the flat tubes forming the parallel passages may be bent in circular arc forms, arranged in an annular form or in such away as to be overlapped to each other and connected to the tubular header, as in the second embodiment.

The heat exchanger of the third embodiment can be employed in all the refrigerating air conditioners shown in FIGS. 2, 4 and 5. In the heat exchanger 10, when the first flat tube 1 and the second flat tube 2 have the same form, the pressure loss generated when the refrigerant of the low temperature in a gas-liquid two-phase state including refrigerant liquid flows in the first flat tube 1 is larger than the pressure loss generated when the refrigerant of the high temperature and the high pressure under a supercritical state flows in the second flat tube 2. However, in this embodiment, since the sectional areas of all the passages of the first flat tubes forming the parallel passages are larger than those of the second flat tubes, a flow velocity in the first flat tube can be suppressed. Thus, a proper pressure loss can be maintained. Further, since the length of the longitudinal direction (the direction L1) of the first flat tube 1 is shorter than the length of the longitudinal direction (the direction L2) of the second flat tube, the pressure loss of the first flat tube can be properly maintained.

As shown in FIG. 3, since the temperature of the refrigerant of the high temperature in the second flat tube becomes lower toward the outlet side and a temperature change is small, an area in which a temperature difference between the high temperature refrigerant and the low temperature refrigerant flowing in the first flat tube is small is increased to deteriorate the heat exchanging performance. However, when the heat exchanger of this embodiment is used, the sectional areas or the number of the passages of the through holes of the first flat tubes 1*a*, 1*b* and 1*c*, and the first flat tubes 1*d*, 1*e* and 1*f* arranged along the flat surfaces can be increased the more in the flat tube that comes into contact with the outlet side of the second flat tube 2 so that the low temperature refrigerant can be supplied the more in the flat tube that comes into contact with the outlet side of the second flat tube 2. Thus, the heat exchanging characteristics can be prevented from being deteriorated.

When the heat exchanger of this embodiment is used, the sectional areas or the number of the passages of the through holes of the second flat tube 2 can be increased the more in the flat tube that comes into contact with the inlet side of the first flat tube 1 so that the high temperature refrigerant can be supplied the more in the flat tube that comes into contact with the inlet side of the first flat tube 1. Thus, a large quantity of high temperature refrigerant flowing in the second flat tube 2 can be made to exchange heat with the low temperature refrigerant of a high cooling performance flowing in the inlet side of the first flat tube 1. Thus, the heat exchanging performance can be enhanced.

As described above, even when there is a difference in thermal material values such as specific heat, density or conditions of a flow rate between the high temperature fluid and the low temperature fluid, the heat exchanging performance can be improved without generating the increase of the pressure loss accompanied with the increase of a flow velocity in the tube.

Fourth Embodiment

Figure 11A:
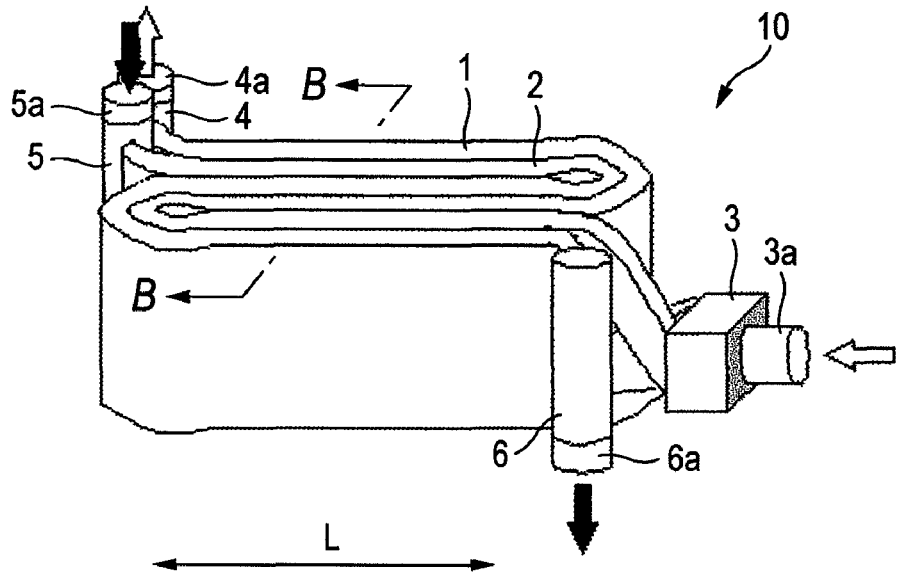
FIGS. 11A and 11B are views showing a heat exchanger according to a fourth embodiment of the present invention.
Figure 11B:
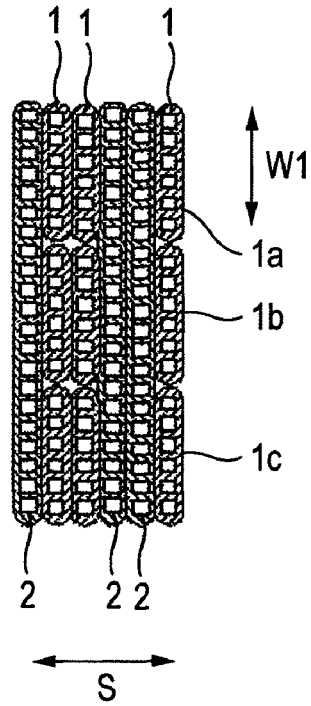

FIG. 11 is a view showing a heat exchanger 10 according to a fourth embodiment of the present invention. FIG. 11A is a perspective view. FIG. 11B is a sectional view on a line b-b of FIG. 11A.

In the drawing, a first flat tube 1 and a second flat tube 2 have a plurality of through holes in which a low temperature fluid and a high temperature fluid respectively flow, and bonded by brazing or the like so that the first flat tube and the second flat tube come into contact with each other on their flat surfaces and the longitudinal directions (the flowing directions of the fluids on the surface on which the first flat tube and the second flat tube come into contact with each other: a direction L) thereof are parallel to each other.

When the flat tubes are formed with a material relatively high in its ductility such as an aluminum alloy, copper and a copper alloy, or a thin flexible member, since the first flat tube 1 and the second flat tube 2 are bonded together on their flat surfaces in parallel with each other in the longitudinal direction (the direction L) and headers are connected to both ends, the flat tubes can be freely bent in the direction intersecting at right angles to the longitudinal direction (the direction L). In FIG. 11, the first flat tube and the second flat tube are folded back to three stages or three layers to form a structure that the first flat tube and the second flat tube are laminated (a direction of lamination: a direction S). Both ends of the first flat tube 1 are respectively connected to a first inlet header 3 and a first outlet header 4. Both ends of the second flat tube 2 are respectively connected to a second inlet header 5 and a second outlet header 6.

The first flat tube 1 includes three flat tubes 1*a*, 1*b* and 1*c* arranged on the flat surface to form parallel passages.

The first inlet header 3 is the tubular header shown in the first embodiment and the second embodiment. The first outlet header 4, the second inlet header 5 and the second outlet header 6 are headers for connecting the flat tubes respectively to the side surfaces of the headers so that the directions of axes of the tubes are parallel to the flat surfaces of the flat tubes.

Since other structures are the same as those of the third embodiment, an explanation is omitted.

In order to increase a heat exchanging performance, a contact area needs to be increased. In this embodiment, since the first flat tube and the second flat tube are arranged so that the flowing directions of the fluids are parallel to each other and the flat tubes are respectively folded back and laminated, the contact area of the first flat tube and the second flat tube can be increased without enlarging the heat exchanger two-dimensionally.

Since the first headers connected to the first flat tube and the second headers connected to the second flat tube may be respectively provided only at both end parts of the flat tubes, the headers do not interfere with each other.

Since the directions of the flows of the low temperature fluid and the high temperature fluid can be opposed to each other, a temperature efficiency can be increased and the heat exchanging performance can be enhanced.

Since at least either one of the first flat tube and the second flat tube (in FIG. 11, only the first flat tube) forms the parallel passages by the plurality of the flat tubes arranged along the flat surface, the flow rate of the fluid can be increased to increase heat exchanging characteristics without increasing a pressure loss. Further, a power of a driving device for supplying and circulating the fluid to the heat exchanger is not increased.

Since either the inlet header or the outlet header connected to the flat tube forming the parallel passages is the tubular header (in FIG. 11, only the first inlet header), the same effects as those of the third embodiment are realized.

The number of stages obtained by folding back the flat tube is not limited to three stages. The number of stages may be one without folding back the flat tube, or may be any of stages not smaller than one and may be freely formed depending on a mounting space of the device.

The heat exchanger of the fourth embodiment can be employed in all the refrigerating air conditioner shown in FIGS. 2, 4 and 5.

In the heat exchanger of this embodiment, since for instance, the longitudinal direction can be freely bent in the direction of lamination relatively low in its rigidity, when the heat exchanger is mounted in an outdoor unit of the refrigerating air conditioner, the heat exchanger can be arranged along the periphery of a shell of a vessel such as a compressor or can be arranged in a space between the vessel and piping and amounting efficiency to the device is improved, which contributes to the miniaturization of the entire part of the device.

Fifth Embodiment

Figure 12A:
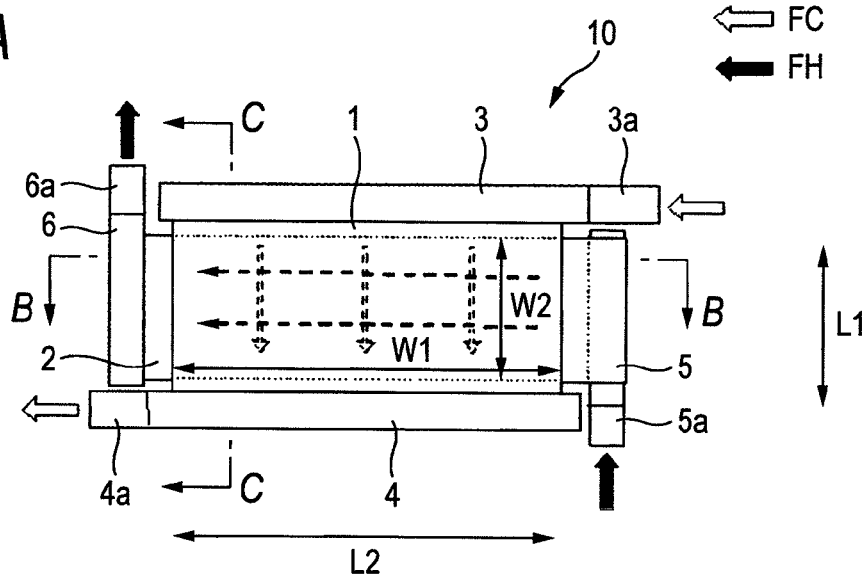
FIGS. 12A-12C are views showing a heat exchanger according to a fifth embodiment of the present invention.
Figure 12B:
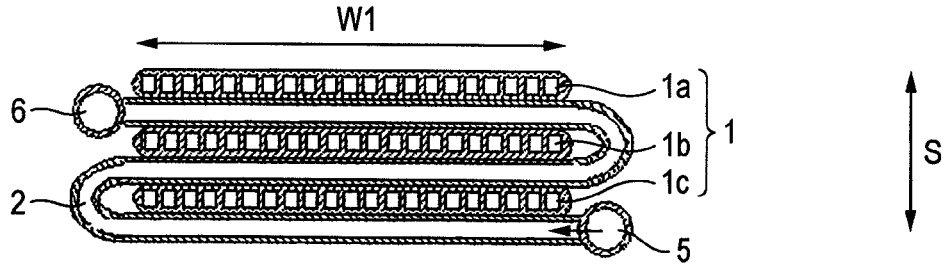
Figure 12C:
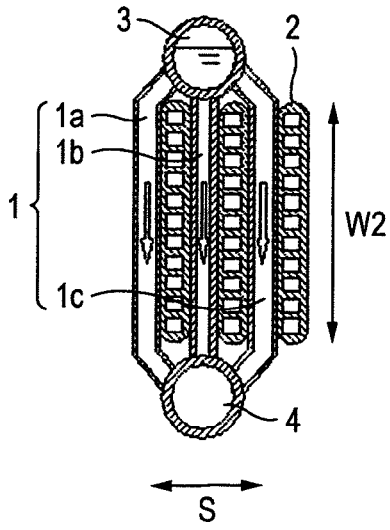

FIG. 12 is a view showing a heat exchanger 10 according to a fifth embodiment of the present invention. FIG. 12A is a front view. FIG. 12B is a sectional view on a line b-b of FIG. 12A. FIG. 12C is a sectional view on a line c-c of FIG. 12A.

In the drawing, a first flat tube 1 and a second flat tube 2 have a plurality of through holes in which a low temperature fluid and a high temperature fluid respectively flow, are alternately laminated with the number of laminated layers of three or more (in FIG. 12, six) and bonded by brazing or the like so that the first flat tube and the second flat tube come into contact with each other on their flat surfaces and the flowing directions (a direction L1 and a direction L2) of the fluids respectively flowing in the flat tubes intersect at right angles to each other.

The first flat tube 1 includes three flat tubes 1*a*, 1*b* and 1*c*. The flat tubes 1*a*, 1*b* and 1*c* are respectively arranged in the direction of lamination (a direction S). Further, the upper and lower ends of the flat tubes are respectively connected to a first inlet header pipe 3 and a first outlet header 4 to form parallel passages.

The second flat tube 2 is folded back in the longitudinal direction (the direction L2) so that three stages or layers are laminated, and both ends are respectively connected to a second inlet header 5 and a second outlet header 6.

As shown in FIG. 12C, the first inlet header 3 and the first outlet header 4 are headers that respectively connect the plurality of the first flat tubes 1*a*, 1*b* and 1*c* to the side surfaces of the headers so that the axial directions of the headers are parallel to the flat surfaces of the flat tubes. The second inlet header 5 and the second outlet header 6 are headers that respectively connect the second flat tube 2 to the side surfaces of the headers so that the axial directions of the headers are parallel to the flat surface of the flat tube.

The headers are respectively connected to connecting piping 3*a*, 4*a*, 5*a* and 6*a*.

The length of the longitudinal direction (the direction L1) of the first flat tube is made to be shorter than the length of the longitudinal direction (the direction L2) of the second flat tube. The length of the direction of width (a direction intersecting at right angles to the flowing direction: a direction W1) of the first flat tube 1 is larger than the length of the direction of width (a direction intersecting at right angles to the flowing direction: a direction W2) of the second flat tube.

In FIG. 12, all the sectional areas or the number of the passages of the through holes of the three first flat tubes are the same, however, the sectional areas or the number of the passages of the through holes of the flat tube may be increased the more in the flat tube that comes into contact with the second flat tube 2.

Similarly, the sectional areas or the number of the passages of the through holes of the second flat tube 2 may be increased the more in the side that comes into contact with the inlet side of the first flat tube 1.

Herein, an example is shown in which the through holes of the first flat tube 1 and the second flat tube 2 are formed in one row, however, the through holes do not need to be formed in one row and may be formed in a plurality of rows.

The form of the through hole is rectangular, however, the form of the through hole may be circular and a protrusion can be formed in an inner surface to increase a heat transfer area and more improve heat exchanging characteristics.

A material of the first flat tube 1 and the second flat tube 2 is an aluminum alloy of the number of 1000s such as A1050 or A1070, the number of 3000s such as A3003 and the number of 6000s. A material of the headers 3 to 6 is iron steel such as stainless steel or carbon steel. A material of the connecting piping 3*a* to 6*a* is copper or a copper alloy and the headers are respectively bonded to the connecting piping by brazing or the like.

In this embodiment, the heat exchanger is shown in which the three first flat tubes 1 laminated in the direction S and one second flat tube 2 folded back to be laminated. However, the number of the flat tubes is not limited to the number of this embodiment. Further, the parallel passages may be formed by the plurality of the flat tubes arranged along the flat surface. Further, the flat tubes arranged along the flat surface may be folded back and laminated.

In FIG. 12, FC designates the flow of the low temperature fluid and FH designates the flow of the high temperature fluid. The low temperature fluid flows in the order of the first inlet header 3, the first flat tube 1, and the first outlet header 4. The high temperature fluid flows in order of the second inlet header 5, the second flat tube 2 and the second outlet header 6. Both fluids exchange heat through the contact surface of the first flat tube and the second flat tube.

In order to increase a heat exchanging performance, a contact area needs to be increased. In this embodiment, since the first flat tube and the second flat tube are alternately laminated and arranged to have the six layers so that the flowing directions of the fluids respectively intersect at right angles to each other, the contact area of the first flat tube and the second flat tube can be increased without enlarging the heat exchanger two-dimensionally. Since the flowing directions of the fluids respectively intersect at right angles to each other, the headers connected respectively to the flat tubes do not interfere with each other. As a result, a compact structure is obtained and a process necessary when the flat tubes or the headers are bonded by brazing during a production can be simplified.

In this embodiment, since the first flat tube and the second flat tube are laminated and arranged so that the flowing directions of the fluids respectively intersect at right angles to each other, the width or the length of the first flat tube can be made to be different from the width or the length of the second flat tube. Accordingly, the length and the width of the flat tubes can be changed depending on the kinds of the low temperature fluid and the high temperature fluid, the temperature efficiency of the fluids respectively can be maximized, further, a pressure loss can be minimized, the heat exchanging performance can be enhanced and the power of a driving device for supplying and circulating the fluid to the heat exchanger can be restrained from being increased.

Since the first flat tube or the second flat tube is formed with a plurality of flat tubes (in FIG. 12, only the first flat tube) to form the parallel passages, the flow rate of the fluid can be increased without increasing the pressure loss and the heat exchanging performance can be enhanced. Further, the power of the driving device for supplying and circulating the fluid to the heat exchanger is not increased.

When the flow rate is increased to increase the heat exchanging performance, the inside diameter of the header needs to be enlarged so as to have a proper flow velocity in order to suppress the pressure loss. Accordingly, to maintain a heat resistance, the thickness is increased so that the outside diameter is extremely increased. However, since the header is formed with the iron steel of high strength, the increase of the outside diameter can be suppressed to effectively miniaturize the entire part of the heat exchanger.

The iron steel such as the stainless steel or the carbon steel forming the header can be brazed and bonded to the aluminum alloy, copper or the copper alloy without generating a fragile compound layer having a low strength. Accordingly, the heat exchanger 10 can be relatively easily attached to copper piping ordinarily used in a domestic air conditioner or an air conditioner for business use by brazing or the like.

Also, it is easily attached to outside copper pipe by arranging a joint pipe 3*a* to 6*a* made of copper or copper alloy.

Since the flat tube is made of the aluminum alloy, the flat tube can be relatively easily attached to the header by brazing or the like. Since the aluminum alloy can be produced by an extrusion molding process of a relatively low cost, a production cost can be restricted.

Further, since the thickness can be more decreased in the aluminum alloy of the number 3000s or the number of 6000s having a relatively high strength, a miniaturization and a low cost can be more realized.

The heat exchanger of the fifth embodiment can be applied to all the refrigerating air conditioners shown in FIGS. 2, 4 and 5. For the refrigerating air conditioner using carbon dioxide as a refrigerant, when the high temperature fluid flowing in the second flat tube of the heat exchanger is a supercritical fluid of high temperature and high pressure and the low temperature fluid flowing in the first flat tube is a gas-liquid two-phase fluid, if the first flat tube and the second flat tube have the same forms, the pressure loss generated when a refrigerant of low temperature in a gas-liquid two-phase state including refrigerant liquid flows in the first flat tube is larger than the pressure loss generated when a refrigerant of the high temperature and the high pressure in a supercritical state flows in the second flat tube. However, in this embodiment, since the first flat tube has the width larger than that of the second flat tube and forms the parallel passages, a flow velocity in the tube can be suppressed. Further, since the length of the first flat tube is short, an appropriate pressure loss can be maintained.

As shown in FIG. 12C, since the first flat tubes 1*a*, 1*b* and 1*c* are vertically arranged and the first inlet header 3 is provided in an upper part, even when the gas-liquid two phase refrigerant enters the first inlet header 3, a liquid surface is apt to be formed in the header due to a gravity separation so that a liquid surface is formed on all the bottom surface (an inlet to the flat tube) in the header. Therefore, the fluid can be equally supplied respectively to the through holes of the three first flat tubes 1*a*, 1*b* and 1*c*, the temperature efficiency of the fluid can be maximized, further, the pressure loss can be minimized and the performance of the heat exchanger can be increased.

As shown in FIG. 3, since the temperature of the refrigerant of the high temperature in the second flat tube becomes lower toward the outlet side and a temperature change is small, an area in which a temperature difference between the high temperature refrigerant and the low temperature refrigerant flowing in the first flat tube is small is increased to deteriorate the heat exchanging performance. However, when the heat exchanger of this embodiment is used, the sectional areas or the number of the passages of the through holes of the first flat tubes 1*a*, 1*b* and 1*c* arranged in the direction of lamination can be increased the more in the flat tube (in FIG. 12, the flat tube 1*a*>the flat tube 1*b*>the flat tube 1*c*) that comes into contact with the outlet side of the second flat tube 2 so that the low temperature refrigerant can be supplied the more to the flat tube that comes into contact with the outlet side of the second flat tube 2. Thus, the heat exchanging characteristics can be prevented from being deteriorated.

When the heat exchanger of this embodiment is used, the sectional areas or the number of the passages of the through holes of the second flat tube 2 can be increased the more in the through holes that come into contact with the inlet side of the first flat tube 1 so that the high temperature refrigerant can be supplied the more to the through holes that come into contact with the inlet side of the first flat tube 1. Thus, a large quantity of high temperature refrigerant flowing in the second flat tube 2 can be made to exchange heat with the low temperature refrigerant of a high cooling performance flowing in the inlet side of the first flat tube 1. Thus, the heat exchanging performance can be enhanced.

As described above, even when there is a difference in thermal material values such as specific heat, density or operation conditions such flowing conditions between both fluids, the heat exchanger can be formed in an optimum state by adjusting the width, the length, the number of laminated stages and the sectional areas and the number of the passages of the through holes of the flat tube without increasing the pressure loss accompanied with the increase of the flow velocity in the tube. Accordingly, the heat exchanging performance can be maximized and accordingly, the performance of the device can be improved.

Since the heat exchanger can be formed in a compact configuration and a quantity of the sealed refrigerant to be used can be restrained from increasing, a compact refrigerating air conditioner having high environmental characteristics can be provided.

Sixth Embodiment

Figure 13A:
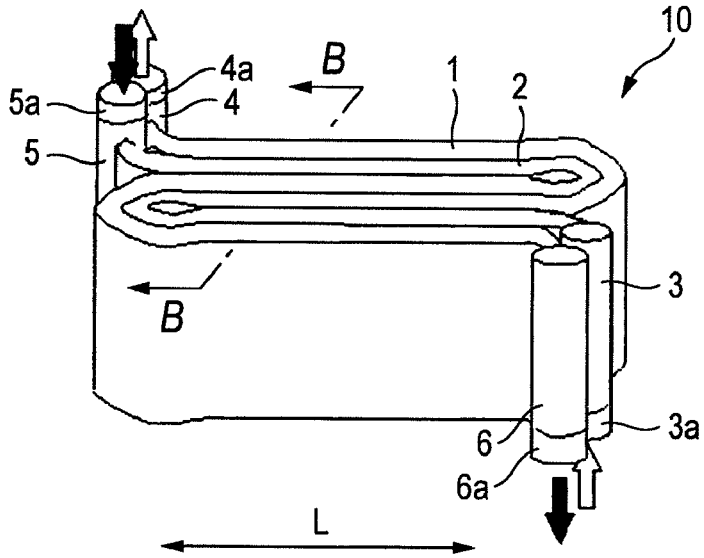
FIGS. 13A and 13B are views showing a heat exchanger according to a sixth embodiment of the present invention.
Figure 13B:
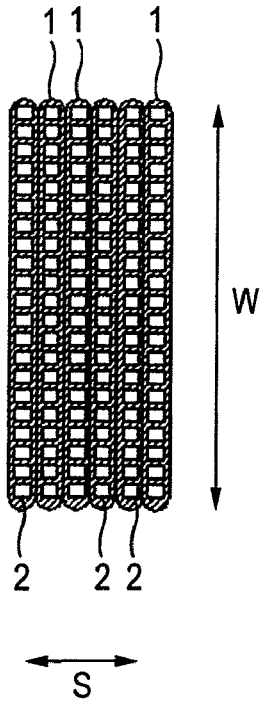

FIG. 13 is a view showing a heat exchanger according to a sixth embodiment of the present invention. FIG. 13A is a perspective view. FIG. 13B is a sectional view on a line b-b of FIG. 13A.

In the drawing, a first flat tube 1 and a second flat tube 2 have a plurality of through holes in which a low temperature fluid and a high temperature fluid respectively flow, and bonded by brazing or the like so that the first flat tube and the second flat tube come into contact with each other on their flat surfaces and the longitudinal directions (the flowing directions of the fluids on the surface on which the first flat tube and the second flat tube come into contact with each other: a direction L) thereof are parallel to each other.

When the flat tubes are formed with a material relatively high in its ductility such as an aluminum alloy, copper and a copper alloy, or a thin flexible member, since the first flat tube 1 and the second flat tube 2 are bonded together on their flat surfaces in parallel with each other in the longitudinal direction (the direction L) and headers are connected to both ends, the flat tubes can be freely bent in the direction intersecting at right angles to the longitudinal direction (the direction L). In FIG. 13, the first flat tube and the second flat tube are folded back to three stages or three layers to form a structure that the first flat tube and the second flat tube are laminated with six layers in the direction of lamination (a direction of lamination: a direction S). Both ends of the first flat tube 1 are respectively connected to a first inlet header 3 and a first outlet header 4. Both ends of the second flat tube 2 are respectively connected to a second inlet header 5 and a second outlet header 6.

The first inlet header 3, the first outlet header 4, the second inlet header 5 and the second outlet header 6 are headers for connecting the flat tubes respectively to the side surfaces of the headers so that the directions of axes of the tubes are parallel to the flat surfaces of the flat tubes.

In order to increase a heat exchanging performance, a contact area needs to be increased. In this embodiment, since the first flat tube and the second flat tube are arranged so that the flowing directions of the fluids are parallel to each other and the flat tubes are respectively folded back and laminated, the contact area of the first flat tube and the second flat tube can be increased without enlarging the heat exchanger two-dimensionally.

Since both the first headers connected to the first flat tube and the second headers connected to the second flat tube may be respectively provided only at both end parts of the flat tubes, the headers do not interfere with each other.

Since the directions of the flows of the low temperature fluid and the high temperature fluid can be opposed to each other, a temperature efficiency can be increased and the heat exchanging performance can be enhanced.

It is to be understood that even when thin tubes having through holes are arranged in place of the flat tubes, the same operation and effects can be obtained.

The heat exchanger of the sixth embodiment can be employed in all the refrigerating air conditioners shown in FIGS. 2, 4 and 5.

When the low temperature fluid of a gas-liquid two-phase state enters the first inlet header 3, the inlet header is more desirably arranged so that a flow in the first flat tube is directed vertically downward. In this case, a liquid surface is apt to be formed in the first inlet header due to a gravity separation, so that a refrigerant is liable to be equally distributed respectively to the through holes of the first flat tube.

In the heat exchanger of this embodiment, since for instance, the longitudinal direction can be freely bent in the direction of lamination relatively low in its rigidity, when the heat exchanger is mounted in an outdoor unit of the refrigerating air conditioner, the heat exchanger can be arranged along the periphery of a component device (for instance, a compressor or a liquid reservoir or the like) or can be arranged in a space between a vessel and piping to improve a mounting efficiency to the device, which contributes to the miniaturization of the entire part of the device.

The number of stages obtained by folding back the flat tube is not limited to three stages. The number of stages may be one without folding back the flat tube, or may be any of stages not smaller than one and may be freely formed depending on a mounting space of the device.

Seventh Embodiment

Figure 14A:
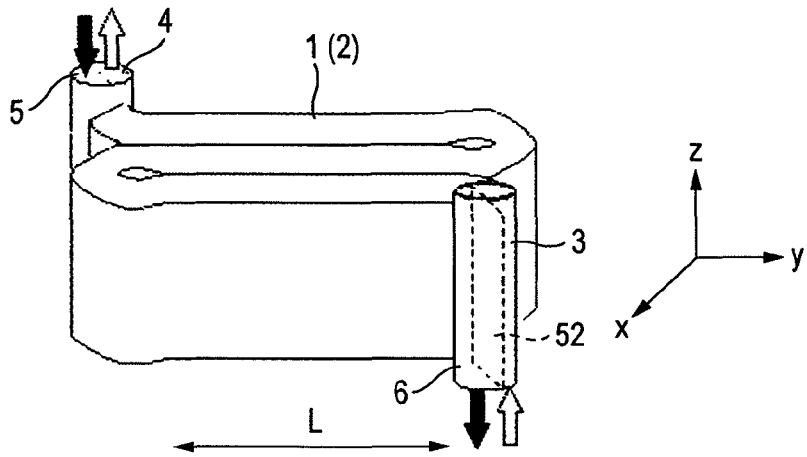
FIGS. 14A-14C are views showing a heat exchanger according to a seventh embodiment of the present invention.
Figure 14B:
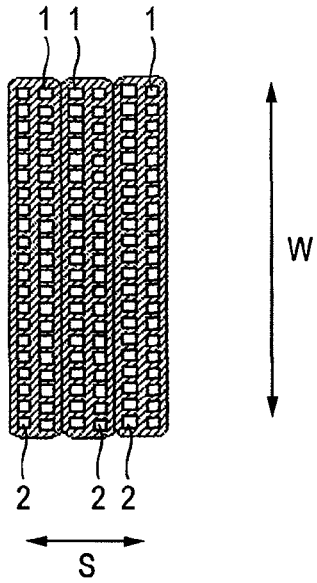
Figure 14C:
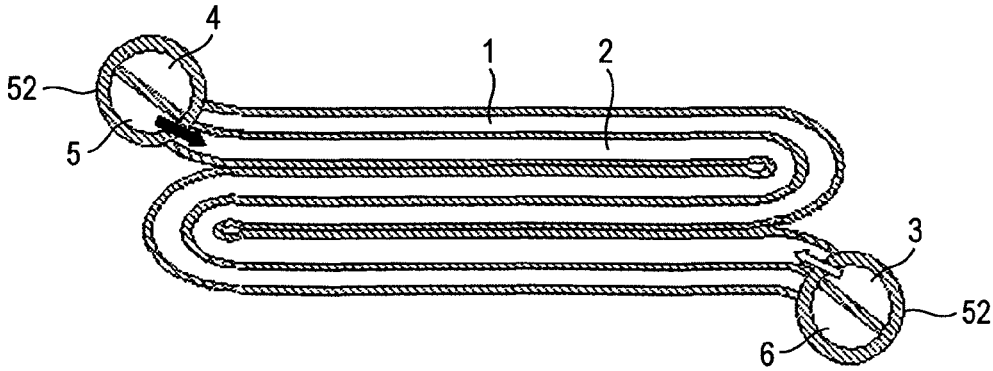

FIG. 14 is a view showing a heat exchanger according to a seventh embodiment of the present invention. FIG. 14A is a perspective view. FIG. 14B is a sectional view on a plane x-z. FIG. 14C is a sectional view on a plane x-y.

In the drawing, a first flat tube 1 and a second flat tube 2 have a plurality of through holes in which a low temperature fluid and a high temperature fluid respectively flow, and are integrally formed so that the longitudinal directions (the flowing directions of the fluids on the surface on which the first flat tube and the second flat tube come into contact with each other: a direction L) thereof are parallel to each other. The integrally formed first flat tube 1 and the second flat tube 2 are made of a material relatively high in its ductility such as an aluminum alloy, copper and a copper alloy, or a thin flexible member and folded back at intermediate parts in the longitudinal direction to form three stages or layers. Further, to both ends of the integrally formed first flat tube 1 and the second flat tube 2, tubular members are connected in such a way that the flat surfaces of the flat tubes are parallel to the directions of axes of tubes. Partition plates 52 are inserted longitudinally into the tubular members so that a first inlet header 3 is arranged to be adjacent to a second outlet header 6 through the partition plate 52 and a first outlet header 4 is arranged to be adjacent to a second inlet header 5 through the partition plate 52. To both ends of the first flat tube 1, the first inlet header 3 and the first outlet header 4 are connected. At both ends of the second flat tube 2, the second inlet header 5 and the second outlet header 6 are connected. The pipe having the passages of the first flat tube and the second flat tube integrally formed can be worked by, for instance, an extrusion molding process of aluminum.

According to such a structure, in addition to the effects of the sixth embodiment, a contact heat resistance between the first flat tube 1 and the second flat tube 2 can be completely removed to greatly improve a heat exchanging performance.

The flat tubes are integrally formed and the headers are integrally formed, so that the heat exchanger is made to be more compact and a production can be extremely simplified.

Here, an example is shown in which the through holes of the first flat tube 1 and the second flat tube 2 are formed in one row, however, the through holes does not need to be formed in one row and may be formed in a plurality of rows.

Eighth Embodiment

Figure 15A:
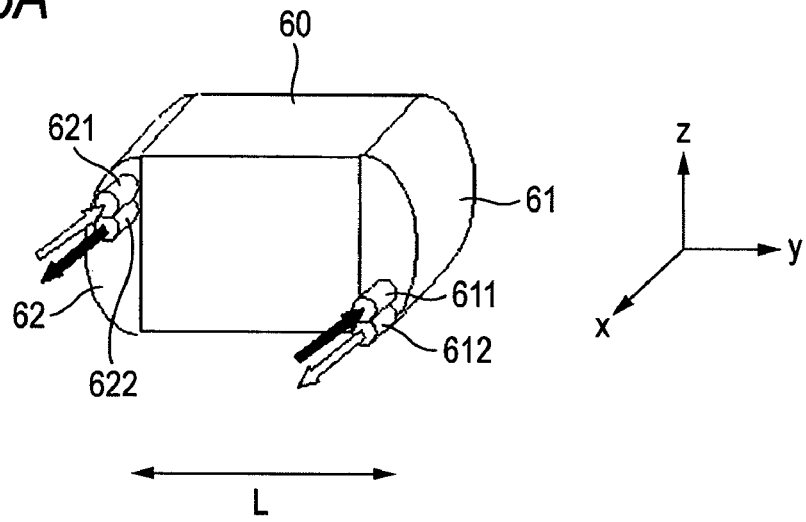
FIGS. 15A-15C are views showing a heat exchanger according to an eighth embodiment of the present invention.
Figure 15B:
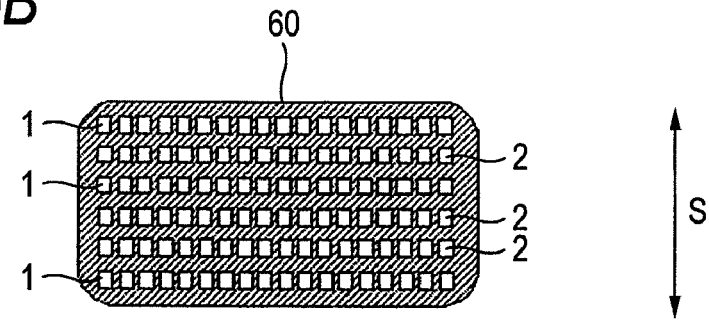
Figure 15C:
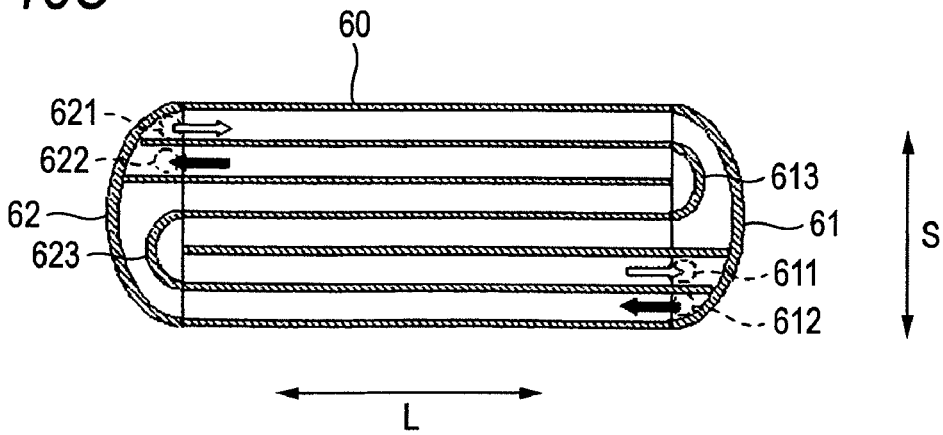

FIG. 15 is a view showing a heat exchanger according to an eighth embodiment of the present invention. FIG. 15A is a perspective view. FIG. 15B is a sectional view on a plane x-z. FIG. 15C is a sectional view on a plane y-z. The heat exchanger includes a porous pipe 60 formed integrally by arranging respectively three stages, the total of six stages of the passages having a plurality of corresponding through holes provided in the first flat tube 1 and the second flat tube 2 of the sixth embodiment and a first header body 61 and a second header body 62 provided at both ends of the porous pipe 60. The first header 61 has therein partition plates for partitioning the first stage to the fourth stage, the fifth stage and the sixth stage of the porous pipe and a first outlet pipe 611 and a second inlet pipe 612 connected so as to respectively communicate with the passages of the fifth stage and the sixth stage of the porous pipe. The second header body 62 has therein partition plates for partitioning the first stage, the second stage and the third stage to the sixth stage of the porous pipe and a first inlet pipe 621 and a second outlet pipe 622 connected so as to respectively communicate with the passages of the first stage and the second stage of the porous pipe. A first cover 613 is incorporated in the first header body 61 to make the passage of the second stage of the porous pipe 60 communicate with the passage of the third passage. A second cover 623 is incorporated in the second header body 62 to make the passage of the third stage of the porous pipe 60 communicate with the passage of the sixth passage.

According to such a structure, a low temperature fluid and a high temperature fluid can alternately flow in opposed directions in such a way that while the low temperature fluid moves zigzag from the first inlet pipe 621 to the first header body 61, the porous pipe 60, the second header body 62 and the first outlet pipe 611, the high temperature fluid moves zigzag from the second inlet pipe 612 to the second header body 62, the porous pipe 60, the first header body 61 and the second outlet pipe 622.

According to such a structure, the same effects as those of the sixth embodiment can be obtained. In addition thereto, the flat tube parts can be more integrally formed and the headers can be integrally formed, so that the heat exchanger is made to be more compact and a production can be extremely simplified.

The first header body 61 and the first cover 613 may be integrally formed, and the second header body 62 and the second cover 623 may be formed integrally, respectively. Thus, the number of parts is reduced so that a production can be more simplified.

Here, an example of the integrally formed porous pipe 60 is shown, however, a porous pipe may be formed by laminating the first flat tube and the second flat tube.

Here, an example is shown in which the through holes forming respectively the passages of the stages are provided in one row, however, the through holes do not need to be formed in one row and may be formed in a plurality of rows.

Ninth Embodiment

Figure 16A:
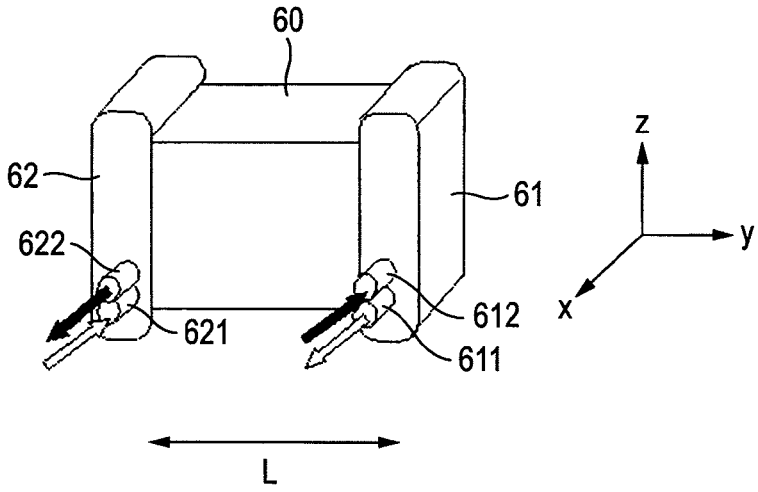
FIGS. 16A-16C are views showing a heat exchanger according to a ninth embodiment of the present invention.
Figure 16B:
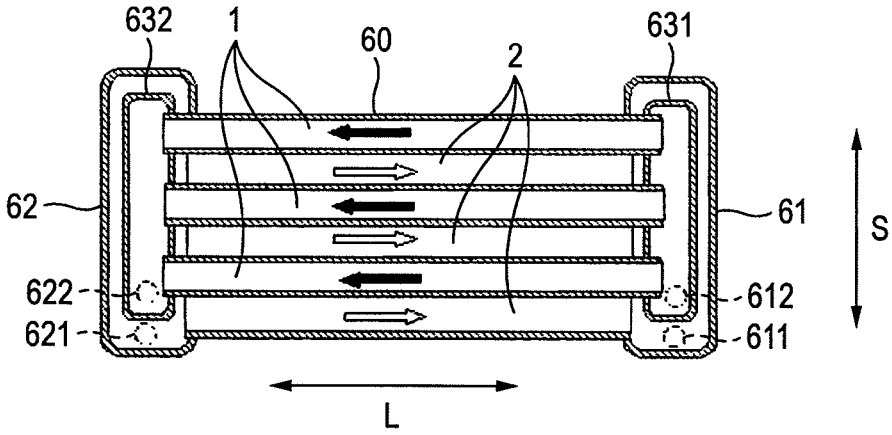
Figure 16C:
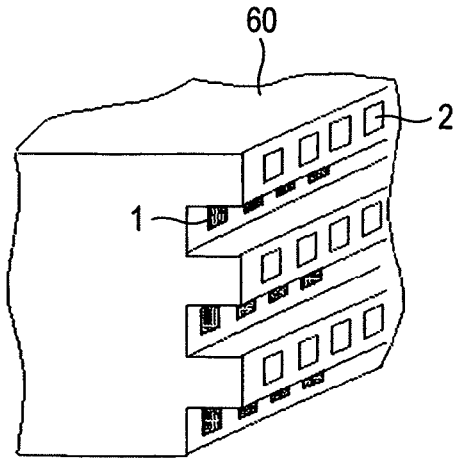

FIG. 16 is a view showing a heat exchanger according to a ninth embodiment of the present invention. FIG. 16A is a perspective view. FIG. 16B is a sectional view on a plane y-z. FIG. 16C is a detailed view of a porous pipe.

The heat exchanger includes a porous pipe 60 formed integrally by arranging respectively three stages, the total of six stages of the passages having a plurality of corresponding through holes provided in the first flat tube 1 and the second flat tube 2 of the sixth embodiment and a first header body 61 and a second header body 62 provided at both ends of the porous pipe 60.

In the first header body 61 and the second header body 62, a first outlet pipe 611 and a first inlet pipe 621 are provided that are respectively connected so as to communicate with the passages of the second, the fourth and the sixth stages of the porous pipe 60.

A first inner header 631 and a second inner header 632 are provided that are incorporated in the first header body 61 and the second header body 62 and respectively connected so as to communicate with the passages of the first, the third and the fifth stages of the porous pipe 60. Further, to the first inner header 631 and the second inner header 632, a second inlet pipe 612 and a second outlet pipe 622 for taking out a high temperature fluid are respectively connected.

According to such a structure, a low temperature fluid and a high temperature fluid can alternately flow in opposed directions in such a way that while the low temperature fluid flows from the first inlet pipe 621 to the second header body 62, the porous pipe 60, the first header body 61 and the first outlet pipe 611, the high temperature fluid flows from the second inlet pipe 612 to the first header body 61, the porous pipe 60, the second header body 62 and the second outlet pipe 622.

Further, here, an example of the integrally formed porous pipe is shown, however, a porous pipe may be formed by laminating the first flat tube and the second flat tube.

According to such a structure, the same effects as those of the sixth embodiment can be obtained. In addition thereto, the structure of the header can be simplified, the heat exchanger is made to be more compact and a production can be extremely simplified.

As shown in FIG. 16C, since the end part of the porous pipe 60 has an irregular structure, the header bodies, the inner headers and the porous pipe are connected together so that the passages to which the high temperature fluid and the low temperature fluid are respectively supplied can be relatively easily formed.

Tenth Embodiment

Figure 17A:
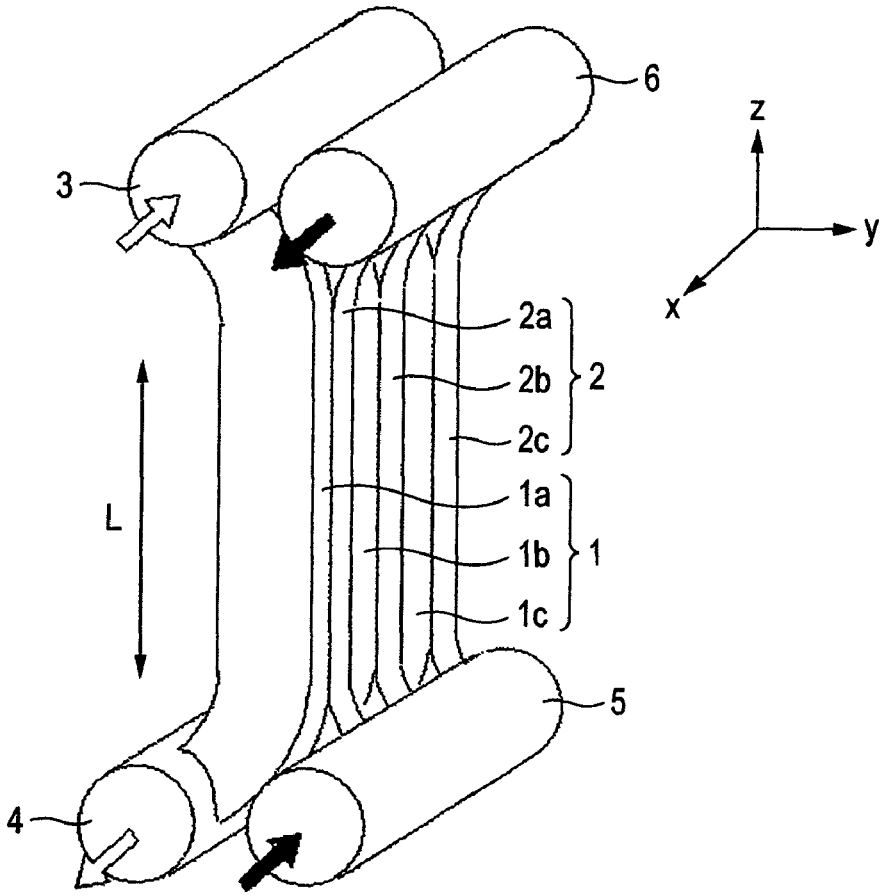
FIGS. 17A and 17B are views showing a heat exchanger according to a tenth embodiment of the present invention.
Figure 17B:
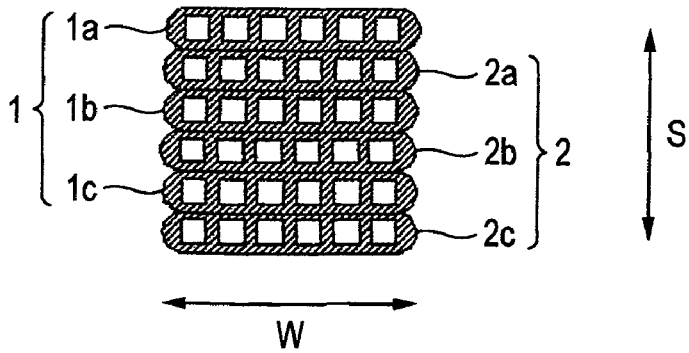

FIG. 17 is a view showing a heat exchanger according to a tenth embodiment of the present invention. FIG. 17A is a perspective view. FIG. 17B is a sectional view on a plane x-y.

A first flat tube 1 and a second flat tube 2 have a plurality of through holes in which a low temperature fluid and a high temperature fluid respectively flow, and are alternately laminated and bonded by brazing or the like so that the first flat tube and the second flat tube come into contact with each other on their flat surfaces and the longitudinal directions (the flowing directions of the fluids on the surface on which the first flat tube and the second flat tube come into contact with each other: a direction L) thereof are parallel to each other.

The first flat tube 1 includes three first flat tubes 1*a*, 1*b* and 1*c* arranged in the direction of lamination (a direction S) and the second flat tube 2 includes three second flat tubes 2*a*, 2*b* and 2*c* arranged in the direction of lamination (a direction S). Both ends of the first flat tubes 1*a*, 1*b* and 1*c* and both ends of the second flat tubes 2*a*, 2*b* and 2*c* are respectively bent by predetermined angles along flat surfaces so that both ends of the first flat tubes 1*a*, 1*b* and 1*c* are not overlapped on both ends of the second flat tubes 2*a*, 2*b* and 2*c* by viewing from the direction of lamination. That is, both end parts of the first flat tubes 1*a*, 1*b* and 1*c* and both end parts of the second flat tubes 2*a*, 2*b* and 2*c* are respectively bent in the direction (a direction W) intersecting at right angles to both the longitudinal direction (the direction L) and the direction of lamination (the direction S) in such a way that both ends of the first flat tube 1 and both ends of the second flat tube 2 do not respectively intersect with each other.

The first flat tubes 1*a*, 1*b* and 1*c* are respectively connected to a first inlet header 3 and a first outlet header 4 at both end parts to form parallel passages.

The second flat tubes 2*a*, 2*b* and 2*c* are respectively connected to a second inlet header 5 and a second outlet header 6 at both end parts to form parallel passages.

A sectional area of the passage (a sectional area vertical to the flowing direction of the fluid) or the number of the through holes of the first flat tube 1 is made to be larger than that of the second flat tube 2. The areas of all the passages of the first flat tube 1 are larger than those of the second flat tube 2.

The first inlet header 3, the first outlet header 4, the second inlet header 5 and the second outlet header 6 are branch headers whose axes of tubes intersect at right angles to the flat surfaces of the plurality of the flat tubes forming the parallel passages. To the side surfaces of the branch headers, the plurality of the flat tubes are connected.

A material of the first flat tube 1 and the second flat tube 2 is an aluminum alloy of the number of 1000s such as A1050 or A1070, the number of 3000s such as A3003 and the number of 6000s. A material of each header is iron steel such as stainless steel or carbon steel. The first flat tube and the second flat tube are respectively bonded to the headers by brazing.

According to the structure of this embodiment, since both ends of the first flat tube or both ends of the second flat tube are bent along the flat surface so that both ends of the first flat tube and both ends of the second flat tube are not overlapped by viewing from the direction of lamination, even when the first flat tube and the second flat tube are alternately laminated so that flowing directions are parallel to each other, the first header connected to the first flat tube does not interfere with the second header connected to the second flat tube. Thus, the plurality of the flat tubes can be laminated in multi-layers to increase a contact area. As a result, a heat exchanging performance can be improved and the heat exchanger can be made to be compact without enlarging two-dimensionally.

Since not only the direction of width of the first flat tube and the second flat tube, but also the direction of lamination thereof can be enlarged, the flow rate of the low temperature fluid and the high temperature fluid can be increased and the heat exchanging performance can be enhanced without increasing the power of a driving device for supplying and circulating the fluid to the heat exchanger due to the increase of a pressure loss.

A process necessary when the flat tubes or the headers are bonded by brazing during a production can be simplified.

Since the first header does not interfere with the second header, the plurality of the first flat tubes and the plurality of the second flat tubes arranged in the direction of lamination can be respectively formed as the parallel passages. Thus, the flow rate of the fluid can be increased and the heat exchanging characteristics can be enhanced without increasing the pressure loss. Further, the power of the driving device for supplying and circulating the fluid to the heat exchanger is not increased.

When the same flat tubes having the same bending angles at both ends are used for the first flat tube and the second flat tube, the upper parts and lower parts of the flat tubes can be inverted and laminated. Accordingly, producing processes and a management can be simplified.

Here, an example is shown in which the through holes of the first flat tube 1 and the second flat tube 2 are formed in one row, however, the through holes do not need to be formed in one row and may be formed in a plurality of rows.

The heat exchanger of the tenth embodiment can be employed in all the refrigerating air conditioners shown in FIGS. 2, 4 and 5.

When the low temperature fluid of a gas-liquid two-phase state enters the first inlet header 3, the inlet header is more desirably arranged so that a flow in the first flat tube is directed vertically downward. In this case, a liquid surface is apt to be formed in the first inlet header due to a gravity separation, so that a refrigerant is liable to be equally distributed respectively to the through holes of the first flat tube.

As the heat exchanger 10, the heat exchanger of the tenth embodiment is employed. When the flat tubes are formed with a material relatively high in its ductility such as the aluminum alloy, copper and the copper alloy, or a thin flexible member, since first flat tube 1 and the second flat tube 2 are bonded together on their flat surfaces in parallel with each other in the longitudinal direction (the direction L), and the headers are connected to both ends, the longitudinal directions can be freely bent in the direction of lamination relatively low in its rigidity. Accordingly, when the heat exchanger is mounted in an outdoor unit of the refrigerating air conditioner, the heat exchanger can be arranged along a component device (for instance, a compressor or a liquid reservoir) or in a space between a vessel and a piping so that a mounting efficiency to the device is improved, which contributes to the miniaturization of the entire part of the device.

The invention claimed is:

1. A heat exchanger comprising:

a first flat tube having a flat shape and through which a low temperature fluid flows;

a second flat tube having a flat shape and through which a high temperature fluid flows;

a first inlet header and a first outlet header respectively connected to first and second ends of the first flat tube; and a second inlet header and a second outlet header respectively connected to first and second ends of the second flat tube, wherein the first flat tube and the second flat tube are laminated and arranged in at least three laminated layers so that the first flat tube and the second flat tube are in contact with each other on flat surfaces, flow direction of the low temperature fluid in the first flat tube intersects, at a right angle, flow direction of the high temperature fluid in the second flat tube, at least one of the first flat tube and the second flat tube includes a plurality of flat tubes arranged along the flat surface or arranged in the direction of lamination, and the first and second inlet and outlet headers are respectively connected to ends of the first and second flat tubes, forming parallel passages.

2. The heat exchanger according to claim 1, wherein one of the first and second inlet headers forming the parallel passages or one of the first and second outlet headers forming the parallel passages, includes a tubular header having open ends, and the first and second flat tubes that form the parallel passages are bundled and connected to an open end of one of the tubular headers so that an axial direction of the header is aligned with the flow direction of one of the high temperature and low temperature fluids in the first and second flat tubes.

3. The heat exchanger according to claim 1, wherein width or length of the first flat tube is respectively different from width or length of the second flat tube.

4. The heat exchanger according to claim 1, wherein the first flat tube and the second flat tube respectively have a plurality of through passages, and the through passages of the first flat tube are different from the through passages of the second flat tube in at least one of number, sectional area of the passage, and pitch of arrangement.

5. The heat exchanger according to claim 1, wherein at least one of the low temperature fluid and the high temperature fluid is in two phases, gas and liquid, and the first flat tube or the second flat tube is arranged so that the flow direction of the fluid in two phases flows in the first flat tube or the second flat tube is vertical.

6. The heat exchanger according to claim 2, wherein at least one of the low temperature fluid and the high temperature fluid is in two phases, gas and liquid, the fluid in two phases flows in the first and second flat tubes forming the parallel passages, and one of the first and second inlet headers connected to the of first and second flat tubes forming the parallel passages includes the tubular header.

7. The heat exchanger according to claim 2, wherein the plurality of first and second flat tubes forming the parallel passages are respectively curved in circular arc shapes at end parts of the first and second flat tubes, arranged in an annular form, and connected to an open end of the tubular header.

8. The heat exchanger according to claim 2, wherein the tubular header includes an orifice having a passage with a sectional area smaller than sectional areas of passages located before and after the orifice.

9. The heat exchanger according to claim 1, wherein at least one of the low temperature fluid and the high temperature fluid contains carbon dioxide.

10. A refrigerating air conditioner including a heat exchanger according to claim 1.

11. A heat exchanger comprising:

a first flat tube having a flat shape and through which a low temperature fluid flows;

a second flat tube having a flat shape and through which a high temperature fluid flows;

a first inlet header and a first outlet header respectively connected to first and second ends of the first flat tube; and a second inlet header and a second outlet header respectively connected to first and second ends of the second flat tube, wherein the first flat tube and the second flat tube are folded, folds of the second flat tube are in contact with folds of the first flat tube, folds of the first flat tube and the second flat tube are in contact with each other on flat surfaces of the first and second flat tubes portions of the flat surface of the first flat tube contact other portions of the flat surface of the first flat tube, portions of the flat surface of the second flat tube contact other portions of the flat surface of the second flat tube, flow direction of the low temperature fluid in the first flat tube is parallel to flow direction of the high temperature fluid in the second flat tube, and the first and second flat tubes are laminated and arranged in at least three layers.

12. The heat exchanger according to claim 11, wherein the first flat tube and the second flat tube are flexible.

13. The heat exchanger according to claim 11, wherein the first inlet header and the first outlet header, or the second inlet header and the second outlet header, are integrated via a tubular member, and are adjacent to each other and separated by a partition plate located in the tubular member.

14. The heat exchanger according to claim 11, wherein at least one of the first flat tube and the second flat tube includes a plurality of flat tubes arranged along a flat surface of the first and second flat tubes, the first and second inlet-headers and the first and second outlet headers respectively connected to ends of the first and second flat tubes form parallel passages, one of the first and second inlet headers and the first and second outlet headers includes a tubular header having open ends and an axial direction, and the first and second flat tubes that form the parallel passages are bundled and connected to an open end of the tubular header so that the axial direction of the tubular header is aligned with the flow direction of one of the high temperature and low temperature fluids in the plurality of the first and second flat tubes.

15. The heat exchanger according to claim 11, wherein the first flat tube and the second flat tube respectively have a plurality of through passages, and the through passages of the first flat tube are different from the through passages of the second flat tube in at least one of number, sectional area of the passage, and pitch of arrangement.

16. The heat exchanger according to claim 11, wherein at least one of the low temperature fluid and the high temperature fluid is in two phases, gas and liquid, and the first flat tube or the second flat tube is arranged so that the flow direction of the fluid in two phases flows in the first flat tube or the second flat tube is vertical.

17. The heat exchanger according to claim 14, wherein at least one of the low temperature fluid and the high temperature fluid is in two phases, gas and liquid, the fluid in two phases flows in the first and second flat tubes forming the parallel passages, and one of the first and second inlet headers connected to the first and second flat tubes forming the parallel passages includes the tubular header.

18. The heat exchanger according to claim 11, wherein the first and second flat tubes forming the parallel passages are respectively curved in circular arc shapes at end parts of the first and second flat tubes, arranged in an annular form, and connected to an open end of the tubular header.

19. The heat exchanger according to claim 14, wherein the tubular header includes an orifice having a passage with a sectional area smaller than sectional areas of passages located before and after the orifice.

20. The heat exchanger according to claim 11, wherein at least one of the low temperature fluid and the high temperature fluid contains carbon dioxide.

21. A refrigerating air conditioner including a heat exchanger according to claim 11.

22. A heat exchanger comprising:

a first flat tube having a flat shape and through which a low temperature fluid flows;

a second flat tube having a flat shape and through which a high temperature fluid flows;

a first inlet header and a first outlet header respectively connected to first and second ends of the first flat tube; and a second inlet header and a second outlet header respectively connected to first and second ends of the second flat tube, wherein the first flat tube and the second flat tube are laminated in a direction of lamination and are arranged so that the first flat tube and the second flat tube come into contact with each other on-flat surfaces, flow direction of the low temperature fluid is parallel to flow direction of the high temperature fluid, at least one of the first flat tube and the second flat tube includes a plurality of flat tubes arranged in the direction of lamination, ends of the first flat tube and ends of the second flat tube are bent in opposite directions, so that both of the flow directions of the high temperature and low temperature fluids are perpendicular to the direction of lamination, and the ends of the first flat tube do not intersect the ends of the second flat tube, and the first and second inlet headers and the first and second outlet headers are respectively located at ends of the first and second flat tubes and form parallel passages.

23. The heat exchanger according to claim 22, wherein the first and second inlet headers forming the parallel passages, or the first and second outlet headers forming the parallel passages, include a branch header having an axis that intersects, at a right angle, the flat surface of of the first and second flat tubes forming the parallel passages, and the first and second flat tubes are connected to a side surface of the branch header.

24. The heat exchanger according to claim 22, wherein the first and second inlet headers forming the parallel passages, or the first and second outlet headers forming the parallel passages, include a tubular header having open ends, and the first and second flat tubes that form the parallel passages are bundled and connected to an open end of one of the tubular headers so that an axial direction of the tubular header is aligned with the flow direction of one of the low temperature and high temperature fluids in the first and second flat tubes.

25. The heat exchanger according to claim 22, wherein at least one of the low temperature fluid and the high temperature fluid is in two phases, gas and liquid, and the first flat tube or the second flat tube is arranged so that the flow direction of the fluid in two phases flows in the first flat tube or the second flat tube is vertical.

26. The heat exchanger according to claim 24, wherein at least one of the low temperature fluid and the high temperature fluid is in two phases, gas and liquid, the fluid in two phases flows in the first and second flat tubes forming the parallel passages, and one of the first and second inlet headers connected to the first and second flat tubes forming the parallel passages includes the tubular header.

27. The heat exchanger according to claim 24, wherein the first and second flat tubes forming the parallel passages are respectively curved in circular arc shapes at end parts of the first and second flat tubes, arranged in an annular form, and connected to an open end of the tubular header.

28. The heat exchanger according to claim 24, wherein the tubular header includes an orifice having a passage with a sectional area smaller than sectional areas of passages located before and after the orifice.

29. The heat exchanger according to claim 22, wherein at least one of the low temperature fluid and the high temperature fluid contains carbon dioxide.

30. A refrigerating air conditioner including a heat exchanger according to claim 22.

31. The heat exchanger according to claim 22, wherein the first flat tube and the second flat tube respectively have a plurality of through passages, and the through passages of the first flat tube are different from the through passages of the second flat tube in at least one of number, sectional area of the passage, and pitch of arrangement.

* * * * *